US006661181B2

(12) United States Patent
Shin

(10) Patent No.: US 6,661,181 B2
(45) Date of Patent: Dec. 9, 2003

(54) BACKLIGHT ASSEMBLY AND LIQUID CRYSTAL DISPLAY DEVICE HAVING THE SAME

(75) Inventor: Chung-Hyuk Shin, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/046,281

(22) Filed: Jan. 16, 2002

(65) Prior Publication Data

US 2002/0130628 A1 Sep. 19, 2002

(30) Foreign Application Priority Data

Jan. 18, 2001 (KR) ..... 2001-2889

(51) Int. Cl.[7] ..... G09G 3/10

(52) U.S. Cl. ..... 315/169.4; 315/291; 315/239; 315/220; 315/312; 345/102

(58) Field of Search ..... 315/169.3, 169.4, 315/185 R, 291, 307, 308, 312, 161, 239, 220, 227, 209 R; 362/217, 219, 221, 227; 345/102, 87; 349/61, 65

(56) References Cited

U.S. PATENT DOCUMENTS 4,100,476 A * 7/1978 Ghiringhelli ..... 315/297
RE33,057 E * 9/1989 Clegg et al. ..... 315/24
5,886,759 A * 3/1999 Mashino et al. ..... 349/65
6,023,131 A * 2/2000 Okita ..... 315/291
6,034,485 A * 3/2000 Parra ..... 315/209 R
6,346,782 B1 * 2/2002 Knoble ..... 315/312
6,411,041 B1 * 6/2002 Parra ..... 315/105
6,465,971 B1 * 10/2002 Parra ..... 315/209 R
6,466,195 B1 * 10/2002 Hashimoto et al. ..... 345/102

* cited by examiner

*Primary Examiner*—Don Wong
*Assistant Examiner*—Ephrem Alemu
(74) *Attorney, Agent, or Firm*—McGuireWoods LLP

(57) ABSTRACT

A connection of electrode lines of lamps for supplying a light source for a backlight assembly of a liquid crystal display (LCD) device is improved to minimize the size of the LCD device while reducing the manufacturing cost. The LCD device includes the backlight assembly having a light emitting unit formed by plural lamps for generating light and a light controlling unit for guiding the light from the light emitting unit, and a display unit placed to the upper plane of the light controlling unit for receiving the light from the light emitting unit via the light controlling unit to display an image. A driving unit is further provided for converting an external power source of a DC component into an AC component to supply first and second driving signals having phases respectively different from each other to the light emitting unit. Plural lamps respectively have two electrodes which include a first electrode directly connected to the electrode of at least one adjacent lamp and selectively have a second electrode supplied with the externally-provided driving signals. Thus, the wiring of the electrode lines of the plural lamps is simplified to decrease the size of the backlight assembly and LCD device while reducing the manufacturing cost.

36 Claims, 26 Drawing Sheets

BACKLIGHT ASSEMBLY AND LIQUID CRYSTAL DISPLAY DEVICE HAVING THE SAME

BACKGROUND OF THE INVENTION

1. Field of the Invention

The present invention relates to a liquid crystal display (hereinafter referred to as "LCD") device, and more particularly to a backlight assembly and an LCD device having the same for improving a wiring connection of electrode lines of lamps that provide the light source for the backlight of the LCD device to minimize the size of the LCD device and to reduce the manufacturing cost.

2. Description of the Related Art

In recent years, information processing appliances have been rapidly developed to have a variety of forms and functions and faster information processing speed. The information processed in such an information processing apparatus has an electrical signal format. A display device serving as an interface is required for a user to confirm the information processed in the information processing apparatus by the naked eyes.

Currently, an LCD device having functions of manifesting full-color and attaining high resolution while attaining lightweight and small size compared with the conventional CRT-type display device. As the result, the LCD device has been widely available as a computer monitor that is a representative information processing apparatus, a household wall-hanging television and so on.

The LCD device applies electric fields to a liquid crystal layer to convert its molecular arrangement. Then, the LCD device converts the changes of the optical properties such as birefringence, optical linearity, dichroism and optical scattering characteristic of liquid crystal cells according to the molecular arrangement, and uses the modulation of the light by the liquid crystal cells.

The LCD device is largely sorted into a TN (Twisted Nematic) type and a STN (Super-Twisted Nematic) type. The liquid crystal display device is, according to the driving method, sorted into an active matrix display type, which uses a switching device and a TN liquid crystal, and a passive matrix type, which uses an STN liquid crystal.

A distinguishable difference of two types is that the active matrix display type is applied to a TFT-LCD that drives the LCD by using a TFT and the passive matrix display type does not use a complicated circuit associated with a transistor.

Also, according to a method of using a light source, it is classified into a transmissive LCD device using a backlight and a reflective LCD using an external light source.

Despite the increased weight and volume, the transmissive LCD device using the backlight as the light source is widely used, because it can independently display images without using an external light source.

FIG. 1 is an exploded perspective view schematically showing a conventional LCD device. FIGS. 2, 3 and 4 are circuit diagrams more specifically showing lamps of the backlight assembly shown in FIG. 1 and configurations of an inverter module for driving the lamps.

Referring to FIG. 1, an LCD device 900 is formed by an LCD module 700 for displaying an image by being supplied with an image signal, and a face panel case 810 and a rear panel case 820 for retaining LCD module 700. Here, LCD module 700 has a display unit 710 including an LCD panel 712 for displaying the image.

Display unit 710 includes LCD panel 712, a data-side printed circuit board (PCB) 714, a gate-side PCB 719, a data-side tape carrier package 716 and a gate-side tape carrier package 718.

LCD panel 712 has a thin film transistor (TFT) substrate 712*a*, a color filter substrate 712*b* and a liquid crystal (not shown).

TFT substrate 712*a* is a transparent glass substrate formed with thin film transistors on a matrix. Source terminals of the TFTs are connected with data lines, and gate terminals are connected with gate lines. Also, drain terminals are formed with pixel electrodes consisting of a transparent conductive material such as Indium-Tin-Oxide (ITO).

Once electrical signals are supplied to the data lines and gate lines, the source terminals and gate terminals of respective TFTs receive the electrical signals. In accordance with the input of the electrical signals, the TFTs are turned-on or turned-off to supply the electrical signals required for forming the pixels to the drain terminals.

A color filter substrate 712*b* is provided facing TFT substrate 712*a*. Color filter substrate 712*b* is formed via a thin film processing of RGB pixels that display predetermined colors when light goes through. Color filter substrate 712*b* is coated with a common electrode formed of ITO over the front surface thereof.

When the power is supplied to the gate terminals and source terminals of the transistors on the aforementioned TFT substrate 712*a*, an electric field is formed between the pixel electrode and common electrode of color filter substrate 712*b*. This electric field changes the alignment angle of the liquid crystal injected between TFT substrate 712*a* and color filter substrate 714*b*. The light transmissivity changes in accordance with the alignment angle. This allows to have a desired pixel status.

In order to control the alignment angle of the liquid crystal of LCD panel 712 and the period of aligning the liquid crystal, a driving signal and a timing signal are supplied to the gate line and data line of the TFT. As shown in the drawing, tape carrier package 716 that is one of a soft circuit board that determines the period of applying the data driving signal is attached to the source side of LCD panel 712. Also, gate-side tape carrier package 718 that is one of the soft circuit board that determines the period of applying the gate driving signal is attached to the gate side thereof.

Data-side PCB 714 and a gate-side PCB 719 for respectively supplying the driving signals to the gate line and data line after being externally received with an image signal out of LCD panel 712 are respectively connected to data tape carrier package 716 on the data line side of LCD panel 712 and gate tape carrier package 718 on the gate line side thereof. Data-side PCD 714 is formed of a source portion that receives the image signal generated from an external information processing apparatus (not shown) such as a computer to supply a data driving signal to LCD panel 712. Also, gate-side PCB 719 is formed with a gate portion for supplying a gate driving signal to the gate line of LCD panel 712. In other words, data-side PCB 714 and gate-side PCB 719 generate the gate driving signal and data signal for driving the LCD device and a plurality of timing signals for supplying the driving signals at the appropriate period, so that the gate driving signal is supplied to the gate line of LCD panel 712 via gate-side tape carrier package 718 and the data signal is supplied to the data line of LCD panel 712 via data tape carrier package 716.

A backlight assembly 720 for supplying the consistent light to display unit 710 is provided under the display unit 710. Backlight assembly 720 includes 1st and 2nd lamp units 723 and 725 equipped at both ends of LCD module 700 for generating the light. 1 st and 2 nd lamp units 723 and 725 are respectively formed by 1st and 2nd lamps 723*a* and 723*b* and 3 rd and 4 th lamps 725*a* and 725*b*, which are respectively shielded by first and second lamp covers 722*a* and 722*b*.

Light guide plate 724 is large enough to correspond to LCD panel 712 of display unit 710 to underlie LCD panel 712 for changing the path of light while guiding the light generated from 1st and 2nd lamp units 723 and 725 toward display unit 710. In FIG. 1, light guide plate 724 is of an edge-type having a uniform thickness, which has lamp units at both ends of light guide plate 724 for enhancing the light efficiency. The number of first and second lamp units 723 and 725 may be properly set to be arranged by considering the overall balance of LCD device 900.

A plurality of optical sheets 726 are provided to the upper side of light guide plate 724 to make the luminance of light outgoing from light guide plate 724 toward LCD panel 712 consistent. A reflecting plate 728 is installed at the lower side of light guide plate 724 to reflect the light leaking from light guide plate 724 toward light guide plate 724 so as to enhance the light efficiency.

Display unit 710 and backlight assembly 720 are fixedly supported by a mold frame 730 which is a receiving container. Mold frame 730 is shaped as a rectangular box with the upper plane opened. Additionally, a chassis 740 is provided for externally bending data-side PCB 714 and gate-side PCB 719 of display unit 710 to fix them to the lower plane of mold frame 730 while preventing the deviation of display unit 710. Chassis 740 is opened for exposing LCD panel 710, of which sidewall portion is inwardly bent in the perpendicular direction to cover the upper periphery of LCD panel 710.

Meantime, even not shown in FIG. 1, LCD device 900 is equipped with a 1st inverter INV1 as shown in FIG. 2 for driving 1st, 2nd, 3rd and 4th lamps 723*a*, 723*b*, 723*c* and 723*d*.

Referring to FIG. 2, 1st inverter INV1 has 1st and 2nd transformers T1 and T2, and 1st and 2nd stabilizing circuits 723*e* and 725*e*. An output terminal at the high voltage level of a secondary side of 1st transformer T1 is connected to respective input sides of 1st and 2nd lamps 723*a* and 723*b*, i.e., the first electrode. 1st and 2nd ballast capacitors C1 and C2 are interposed between the output terminal at the high voltage level of the secondary side of 1st transformer T1 and the first electrodes of 1st and 2nd lamps 723*a* and 723*b*. In association with output sides of 1st and 2nd lamps 723*a* and 723*b*, i.e., second electrodes, 1st and 2nd return wires (hereinafter referred to as "RTN") 723*c* and 723*d* respectively extend long to 1st stabilizing circuit 723*e* within 1st inverter INV1. 1st and 2nd RTNs 723*c* and 723*d* are connected to 1st stabilizing circuit 723*e* to supply a feedback current. Referring to FIG. 2, first electrodes of 3rd and 4th lamps 725*a* and 725*b* are connected to output terminals at the high voltage level of a secondary side of 2nd transformer T2 by interposing 3rd and 4th ballast capacitors C3 and C4. Second electrodes of 3rd and 4th lamps 725*a* and 725*b* are connected to 2nd stabilizing circuit 725*e* within 1st inverter INV1 via 3rd and 4th RTNs 725*c* and 725*d* which extend toward 1st inverter INV1, thereby supplying the feedback current.

However, when a single transformer is utilized to drive the plurality of lamps and the electrodes of the lamps are connected in parallel with each other as described above, the current supplied from single transformer is separately supplied to respective lamps. Accordingly, the current applied to respective lamps has a current difference as indicated by the Table 1 below due to a variable load property of the lamp and a difference of a leakage current. Such a current difference becomes large as the lamp current supplied from the transformer becomes lower. Consequently, if the total current of the lamp is low, one side of the lamp is not driven to differ the durability of respective lamps.

TABLE 1

(units: mArms)

| Total Lamp Current | Current of Lamp 1 (723a) | Current of Lamp 2 (723b) | Current Difference of Lamps | Average Current |
|---|---|---|---|---|
| 12.7 | 6.9 | 5.8 | 1.1 | 6.35 |
| 11.2 | 6.6 | 4.6 | 2.0 | 5.60 |
| 9.7 | 7.5 | 2.2 | 5.3 | 4.85 |
| 8.0 | 7.0 | 1.0 | 6.0 | 4.00 |
| 5.8 | 5.8 | 0 | 5.8 | 2.90 |
| 4.0 | 4.0 | 0 | 4.0 | 2.00 |

In order to solve this problem, as shown in FIG. 3, a driving system for corresponding the lamp and transformer one by one has been suggested.

Referring to FIG. 3, a 2nd inverter INV2 has 1st, 2nd, 3rd and 4th transformers T1, T2, T3 and T4 and 1st and 2nd stabilizing circuits 723*e* and 725*e*. 1st, 2nd, 3rd and 4th transformers T1, T2, T3 and T4 are respectively driven by 1st, 2nd, 3rd and 4th controllers CT1, CT2, CT3 and CT4. The first electrodes of 1st and 2nd lamps 723*a* and 723*b* are connected to the output terminals at the high voltage level of the secondary sides of 1st and 2nd transformers T1 and T2 by interposing 1st and 2nd ballast capacitors C1 and C2. Also, the second electrodes of respective 1st and 2nd lamps 723*a* and 723*b* are serially connected to 1st stabilizing circuit 723*e* within 2nd inverter INV2 by means of respective 1st and 2nd RTNs 723*c* and 723*d*. In the same way, the first electrodes of 3rd and 4th lamps 725*a* and 725*b* are respectively connected to the output terminals at the high voltage level of the secondary sides of 3rd and 4th transformers T3 and T4 by interposing 3rd and 4th ballast capacitors C3 and C4. In addition, the second electrodes of 3rd and 4th lamps 725*a* and 725*b* are serially connected to 2nd stabilizing circuit 725*e* within 2nd inverter INV2 by means of 3rd and 4th RTNs 725*c* and 725*d*, respectively. However, if the lamps are driven by one-to-one corresponding transformers as shown in FIG. 3, the frequency among respective transformers of the inverter is not easily synchronized. Therefore, the lamp generates light flickering, making it impossible to obtain a suitable light source as backlight of the LCD device.

In order to solve the above problem, as shown in FIG. 4, a method has been proposed in which the lamp corresponds to the transformer one by one and the transformers are coupled in pairs.

More specifically, referring to FIG. 4, a 3rd inverter INV3 is formed by 1st, 2nd, 3rd and 4th transformers T1, T2, T3 and T4 and 1st and 2nd stabilizing circuits 723*e* and 725*e*. Low voltage level terminals of the secondary sides of 1st and 2nd transformers T1 and T2 are directly connected to low voltage level terminals of the secondary sides of 3rd and 4th transformers T3 and T4. 1st and 2nd transformers T1 and T2 are driven by 1st controller CT1, and 3rd and 4th transformers T3 and T4 are driven by 2nd controller CT2.

On the other hand, the first electrode of 1st lamp 723*a* is connected to the output terminal at the high voltage level of 1st transformer T1 by interposing 1st ballast capacitor C1, and the first electrode of 2nd lamp 723*b* is connected to the output terminal at the high voltage level of 2nd transformer T2 by interposing 2nd ballast capacitor C2. The second electrodes of 1st and 2nd lamps 723*a* and 723*b* are serially connected to 1st stabilizing circuit 723*e* within 3rd inverter INV3 by means of 1st and 2nd RTNs 723*c* and 723*d*, respectively. Similarly, the first electrode of 3rd lamp 725*a* is connected to the output terminal at the high voltage level of 3rd transformer T3 by interposing 3rd ballast capacitor C3. Also, the first electrode of 4th lamp 725*b* is connected to the output terminal at the high voltage level of 4th transformer T4 by interposing 4th ballast capacitor C4. The second electrodes of 3rd and 4th lamps 725*a* and 725*b* are serially connected to 2nd stabilizing circuit 725*e* within 3rd inverter INV3 by means of 3rd and 4th RTNs 725*c* and 725*d*, respectively However, although the above-described difficulty of synchronizing the frequency and problem of the flickering phenomenon are solved by coupling the transformers in pairs, the second electrodes of respective lamps are still connected to the stabilizing circuit on the electrical basis by means of the RTN that extends long toward the inverter side. Hence, any increase in the number of lamps not only produces a difficulty in the electrical wiring but also involves a problem of higher manufacturing costs of the backlight assembly.

FIGS. 5A and 5B show the configuration of the lamps and inverter module of the direct-type LCD device.

As shown in FIG. 5A, the LCD device is formed in a manner that lamp 727 that provides the light is arranged on the bottom plane of a mold frame 730 with a reflecting plate 728 interposed therebetween. Because lamp 727 supplies the light source at the rear side of a display unit 710, no light guide plate 724 for guiding the side light source toward display unit 710 side is employed, unlike the edge-type LCD device as shown in FIG. 1.

By reflecting the structural feature, direct-type LCD device 900, as shown in FIG. 5B, is capable of employing a plurality of lamps 727*a*, 727*b*, 727*c*, 727*d*, 727*e*, 727*f*, 727*g* and 727*h*. A 4th inverter INV4 shown in FIG. 5B adopts the configuration of 2nd or 3rd inverter INV2 or INV3 shown in FIG. 3 or FIG. 4, in which the connection with the first electrodes of plurality of lamps 727*a*, 727*b*, 727*c*, 727*d*, 727*e*, 727*f*, 727*g* and 727*h* is identical to that of 2nd or 3rd inverter INV2 or INV3. Similarly, the second electrodes of plurality of lamps 727*a*, 727*b*, 727*c*, 727*d*, 727*e*, 727*f*, 727*g*and 727*h* are connected to a stabilizing circuit (not shown) within 4th inverter INV4 by means of respective RTNs RTN1, RTN2, RTN3, RTN4, RTN5, RTN6, RTN7 and RTN8.

Also in the direct-type LCD device shown in FIG. 5, the second electrodes of the plurality of lamps are connected to the stabilizing circuit of the inverter via separately-provided RTNs as the driving system shown in FIG. 3 or FIG. 4. Consequently, the lamp unit becomes bulky as the number of RTNs increases. Further, the manufacturing cost of the backlight assembly increases as the number of RTNs increases.

SUMMARY OF THE INVENTION

In order to solve the above-mentioned problems of the prior art, an object of the present invention is to provide a backlight assembly capable of improving a connection of electrode lines of lamps that supply a light source for backlight of the LCD device to minimize the size of an LCD device and reduce the manufacturing cost.

Another object of the present invention is to provide an LCD device having a backlight assembly capable of improving a connection of electrode lines of lamps that supply a light source for backlight of the LCD device to minimize the LCD device size and reduce the manufacturing cost thereof.

To achieve the above object of the present invention, there is provided a backlight assembly including a light emitting unit formed of a plurality of lamps for generating light, and a light controlling unit for enhancing luminance of the light supplied from the light emitting unit. Here, each of the plurality of lamps respectively have two electrodes that include a first electrode directly connected to an electrode of at least one adjacent lamp and selectively have a second electrode supplied with externally provided driving signals.

A liquid crystal display device for achieving the above object of the present invention includes a backlight assembly having light emitting unit formed of a plurality of lamps for generating light, and light controlling unit for enhancing luminance of the light supplied from the light emitting unit. In addition, a display unit placed on an upper plane of the light controlling unit receives the light from the light emitting unit via the light controlling unit to display an image. Here, each of the plurality of lamps respectively have two electrodes, and the two electrodes include a first electrode directly connected to an electrode of at least one adjacent lamp and selectively have a second electrode supplied with externally-provided driving signals.

At this time, the driving signals are of first and second driving signals having a phase difference of 180° from each other, or N (where N is a constant larger than or the same as 2)—numbered driving signals respectively having a phase difference as many as a value obtained by dividing 360° by the number of the plurality of lamps. At this time, when the driving signals is N-numbered, the sum of respective phases of the N-numbered driving signals is zero.

Preferably, the light emitting unit has at least two lamps, the at least two lamps are serially connected to each other, and electrodes of the most preceding lamp and the finally succeeding lamp are supplied with the first and second driving signals, respectively.

More preferably, the backlight assembly further has a driving unit for converting the external power source of a DC component into an AC component, and generating the first and second driving signals having the phase different from each other. Also, the driving unit further has a stabilizing circuit for stabilizing current of the plurality of lamps. Thus, low voltage sides of respective secondary sides of the plurality of transformers are connected to the stabilizing circuit, so that the feedback current for stabilizing the current of the plurality of lamps is supplied to stabilizing circuit.

At this time, the light emitting unit is placed to contact one end or both ends of the light controlling unit. When the light emitting unit is placed to one end of the light controlling unit, the light controlling unit is a wedge-type light guide plate that becomes thinner as advancing from one end placed with the light emitting unit to the other opposing end.

Moreover, the light emitting unit may be placed to the lower plane of the light controlling unit. In this case, the light controlling unit is formed by a plurality of optical sheets for making the luminance of the light supplied from the light emitting unit to the display unit consistent.

According to the above-described backlight assembly and liquid crystal display device, the first electrodes of the lamps are respectively connected to the output terminals at the high voltage level of the secondary sides of the corresponding transformers among the transformers constituting the driving unit. Also, the second electrodes of the lamps are directly connected to one another on the electrical basis. The output terminals at the low voltage level of the secondary sides of the transformers are directly connected to the stabilizing circuit to supply the feedback current for stabilizing the current of the lamps to the stabilizing circuit.

Therefore, because the second electrodes of respective lamps are not required to extend to the stabilizing circuit of the inverter module so as to supply the feedback current to the stabilizing circuit, no RTN is utilized. For this reason, the wiring structure of the electrode lines of the lamps employed to the backlight assembly is simplified to to reduce the size of the backlight assembly while reducing the manufacturing cost of the backlight assembly and LCD device.

BRIEF DESCRIPTION OF THE DRAWINGS

The above objects and other advantages of the present invention will become more apparent by describing in detail preferred embodiments thereof with reference to the attached drawings.

DETAILED DESCRIPTION OF THE PREFERRED EMBODIMENTS

Figure 6:
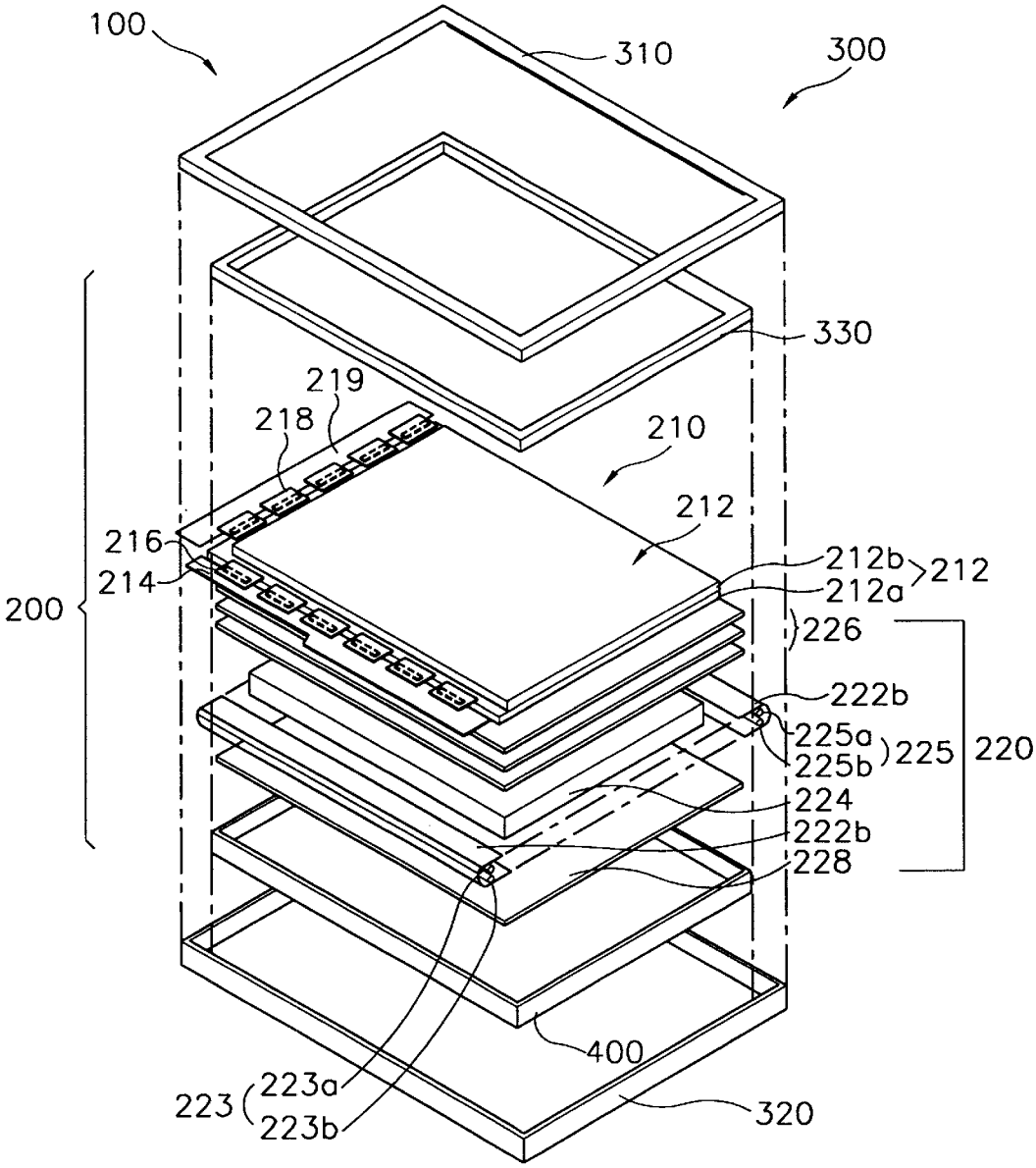
FIG. 6 is an exploded perspective view showing a liquid crystal display device according to a preferred embodiment of the present invention.

FIG. 6 is an exploded perspective view for schematically showing an LCD device according to a preferred embodiment of the present invention.

Referring to FIG. 6, an LCD device 100 includes an LCD module 200 for displaying an image by receiving an image signal, and a case 300 formed by a front case 310 and a rear case 32 for accommodating LCD module 200 therein.

LCD module 200 has a display unit 210 including an LCD panel 212 for displaying the image.

Display unit 210 includes LCD panel 212, a data-side PCB 214, a data-side tape carrier package 216, a gate-side PCB 219 and a gate-side tape carrier package 218.

LCD panel 212 is formed of a TFT substrate 212*a*, a color filter substrate 212*b* and a liquid crystal (not shown).

TFT substrate 212*a* is a transparent glass substrate formed with TFTs in the matrix form. Source terminals of the TFTs are connected with data lines, and gate terminals are connected with gate lines. Additionally, drain terminals are formed with pixel electrodes consisting of the ITO that is a transparent conductive material.

Once an electrical signal is supplied to the data lines and gate lines, the source terminals and gate terminals of respective TFTs receive the electrical signal. In accordance to the electrical signal, the TFTs are turned-on or turned-off to provide the electrical signal for the pixels via the drain terminals.

Color filter substrate 212*b* is formed facing TFT substrate 212*a*. Color filter substrate 212*b* has the RGB pixels that displays predetermined colors when the light passes through. The RGB pixels are formed by a thing film processing. The common electrode formed of ITO is coated over the whole surface of color filter substrate 212*b*.

When the electric power is supplied to the gate terminal and source terminal of the TFT on TFT substrate 212*a* to turn on the TFT, an electrical field is formed between the pixel electrode and common electrode of the color filter substrate. This electrical field changes the alignment of the liquid crystal injected between TFT substrate 212*a* and color filter substrate 214*b*. Then the changed alignment alters the light transmissivity, to obtain a desired pixel.

In order to control the alignment angle and period of the liquid crystal of LCD panel 212, a driving signal and a timing signal are supplied to the gate line and data line of the TFT.

As shown in the drawing, the source side of LCD panel 212 is attached with data tape carrier package 216 which is one of a soft circuit board that determines the period of supplying the data driving signal, and the gate side thereof is attached with gate tape carrier package 218 for determining the period of supplying the gate driving signal.

Data-side PCB 214 and gate-side PCB 219 for receiving the image signal from outside of LCD panel 212 to respectively supply the driving signals to the gate line and data line are respectively connected to data tape carrier package 214 at the data line side of LCD panel 212 and gate tape carrier package 210 at the gate line side thereof. Data-side PCB 214 is formed with a source portion for receiving the image signal generated from an external information processing apparatus (not shown) such as a computer to supply the data driving signal to LCD panel 212. Gate-side PCB 219 is formed with a gate portion for receiving the image signal generated from the external information processing apparatus to supply the gate driving signal to the gate line of LCD panel 212.

In other words, data-side PCB 214 and gate-side PCB 219 generates the gate driving signal and data signal for driving the LCD device and the plurality of timing signals for supplying the driving signals at the appropriate time. They supply the gate driving signal to the gate line of LCD panel 212 via gate tape carrier package 218 and the data signal to the data line of LCD panel 212 via data tape carrier package 216.

A backlight assembly 220 is provided under display unit 210 for providing consistent light to display unit 210. Backlight assembly 220 includes 1st and 2nd lamp units 223 and 225 installed to one side of LCD module 200 for generating the light. 1st and 2nd lamp units 223 and 225 are formed by 1st & 2nd lamps 223*a* & 223*b* and 3rd & 4th lamps 225*a* & 225*b*, which are respectively shielded by first and second lamp covers 222*a* and 222*b*.

A light guide plate 224 has a size corresponding to LCD panel 212 of display unit 210 and underlies LCD panel 212 for changing the path of light generated from 1st and 2nd lamp units 223 and 225 while guiding the light toward display unit 210 side. In FIG. 6, light guide plate 224 is of an edge-type with constant thickness, and 1st and 2nd lamp units 223 and 225 are installed at both ends of light guide plate 224 to enhance the light efficiency. The number of lamps in 1st and 2nd lamp units 223 and 225 may be properly arranged by considering the overall balance of LCD device 100.

A plurality of optical sheets 226 are provided over light guide plate 224 for making the luminance of the light emitted from light guide plate 224 and reflecting toward LCD panel 212 consistent. A reflecting plate 228 is provided below light guide plate 224 for reflecting the light leaking from light guide plate 224 to light guide plate 224 for enhancing the efficiency of the light.

Display unit 210 and backlight assembly 220 are fixedly supported by a mold frame 400 that is a retaining container. Mold frame 400 is a box-like rectangle with an upper plane opened. In addition to these, a chassis 330 is formed for externally bending data tape carrier package 216 and gate tape carrier package 218 of display unit 210 out of mold frame 400 while fixing data PCB 214 and gate PCB 219 to the bottom plane of mold frame 400 to prevent the deviation of display unit 210. Chassis 330 is opened for exposing LCD panel 210 and the sidewall thereof is inwardly bent in the perpendicular direction to cover the upper periphery portion of LCD panel 210.

Figure 7:
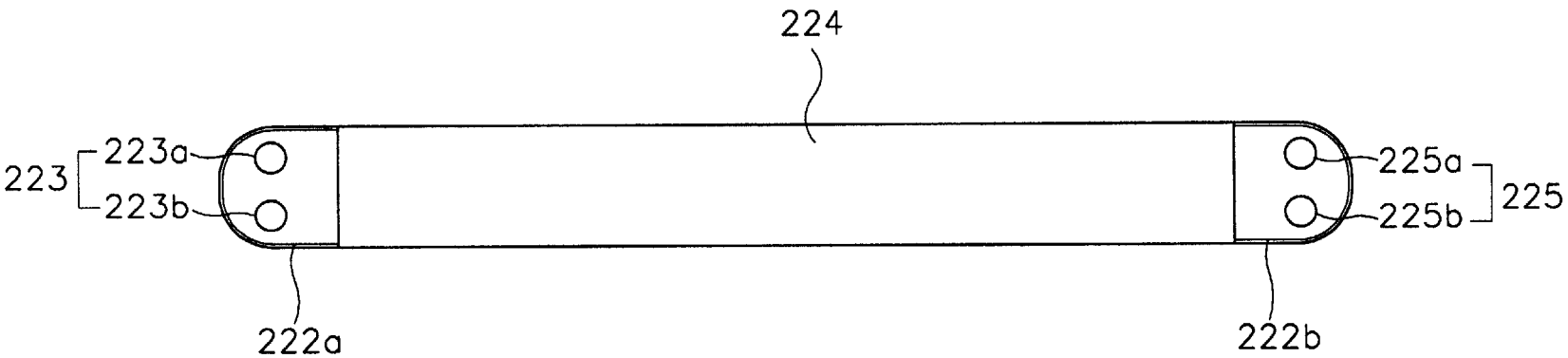
FIG. 7 is a sectional view showing the sectional structure of the light guide plate and lamp unit shown in FIG. 6.

FIG. 7 is a sectional view showing the sectional structure of the light guide plate and lamp unit shown in FIG. 6.

Referring to FIG. 7, one end of light guide plate 224 is coupled with first lamp cover 222*a*, and 1st and 2nd lamps 223*a* and 223*b* are arranged up and down in the interior of first lamp cover 222*a*. Additionally, second lamp cover 222*b* is coupled to the other end opposing to one end of light guide plate 224, and 3rd and 4th lamps 225*a* and 225*b* are arranged up and down in the interior of second lamp cover 222*b*.

The up and down arrangement of two lamps such as 1st and 2nd lamps 232*a* and 232*b* shown in FIG. 7 may be identically applied to the wedge-type light guide plate which becomes thinner as advancing from one end toward the other end. The difference is that the lamp unit is installed only at one end of the light guide plate in the wedge-type light guide plate. The wedge-type light guide plate will be described later.

Figure 8:
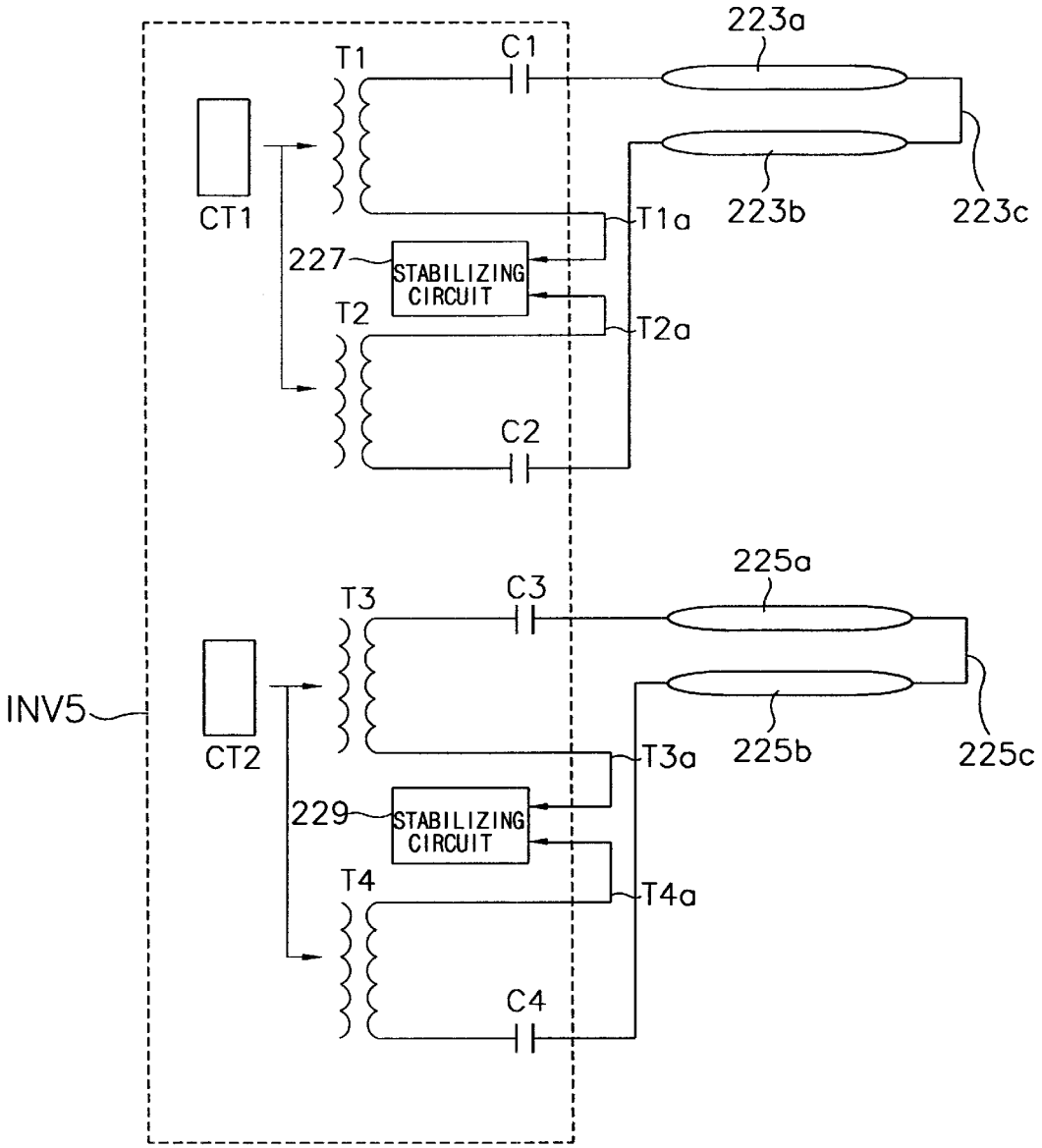
FIG. 8 is a circuit diagram showing a first embodiment of the configuration of the lamps of the backlight assembly shown in FIG. 6 and inverter module for driving the lamps.

Meanwhile, although not shown in FIG. 6, aforementioned LCD device 100 is formed with a 5th inverter INV5 that supplies an AC signal for driving 1st, 2nd, 3rd and 4th lamps 223*a*, 223*b*, 225*a* and 225*b* as shown in FIG. 8.

Figure 9:
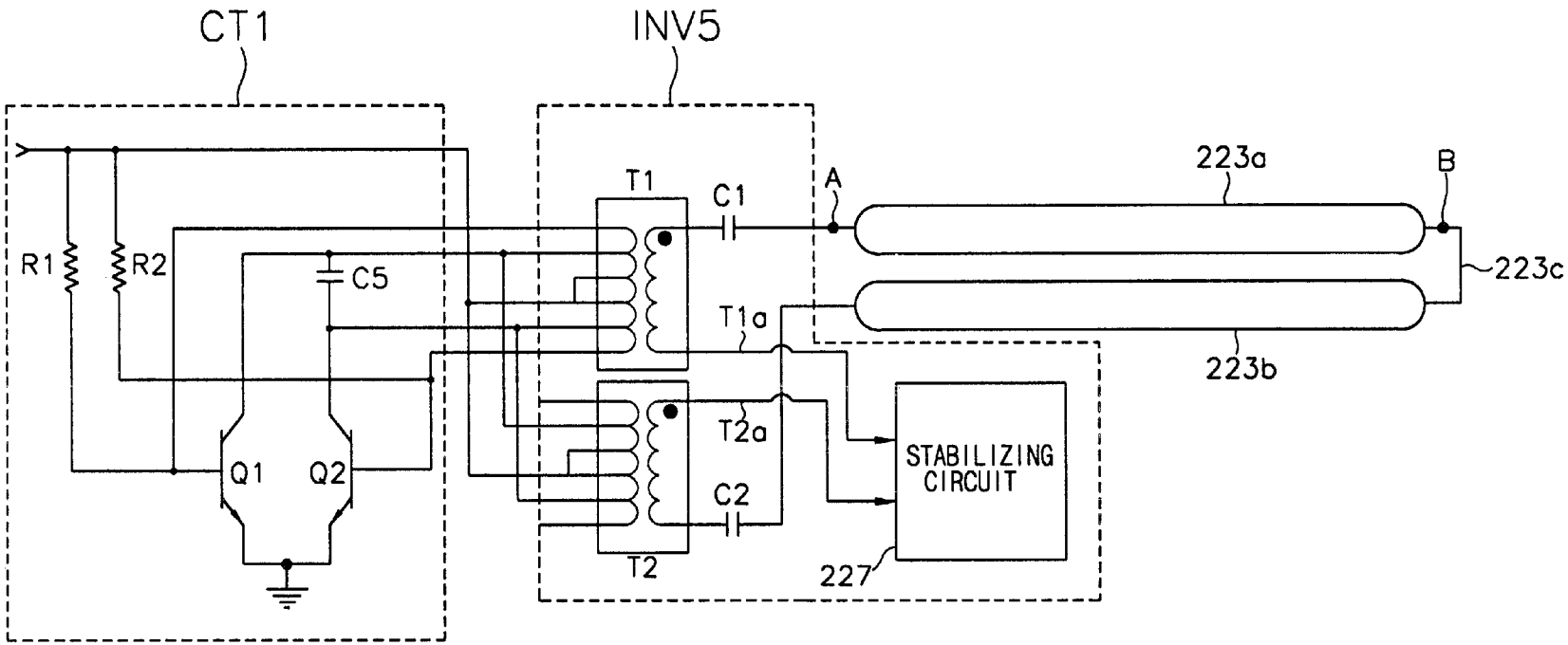
FIG. 9 is a circuit diagram showing the configuration of the lamps and inverter module according to the first embodiment shown in FIG. 8 in more detail.
Figure 10:
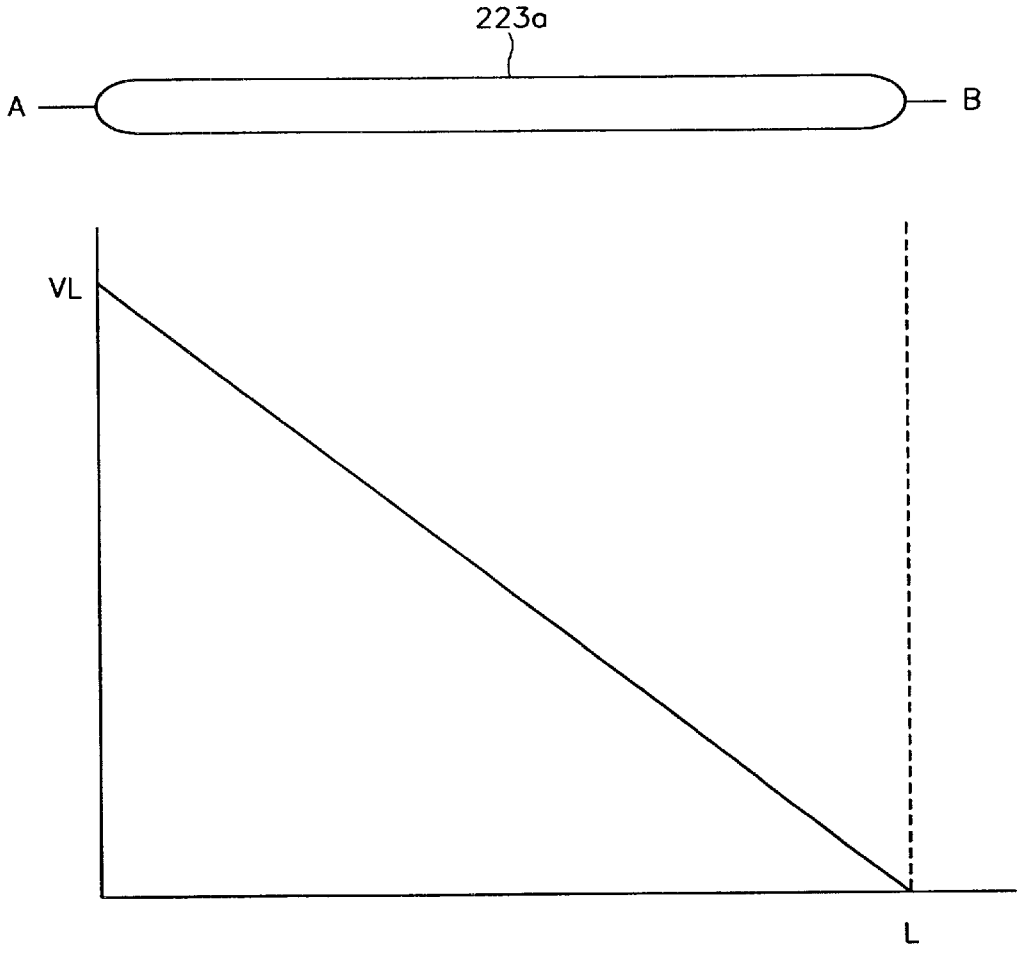
FIG. 10 is a graph for illustrating the potential difference at both ends of the lamp according to the first embodiment shown in FIG. 8.

FIG. 8 is a circuit diagram showing the configuration of the lamps of the backlight assembly shown in FIGS. 6 and 7 and the inverter module for driving the same. FIG. 9 is a circuit diagram showing the lamps and inverter module shown in FIG. 8 in more detail. FIG. 10 is a graph for explaining a potential difference at both ends of the lamp shown in FIG. 8.

Referring to FIG. 8, 5th inverter INV5 has 1st, 2nd, 3rd and 4th transformers T1, T2, T3 and T4 numbering the same as the number of lamps employed to the backlight assembly. Here, 1st and 2nd transformers T1 and T2 are driven by the driving signal from a 1st controller CT1, and 3rd and 4th transformers T3 and T4 are driven by the driving signal of a 2nd controller CT2.

The output terminal at the high voltage level of the secondary side of 1st transformer T1 is connected to the input side, i.e., first electrode, of 1st lamp 223*a*. A 1st ballast capacitor C1 for stabilizing the current of 1st lamp 223*a* is interposed between the output terminal at the high voltage level of the secondary side of 1st transformer TI and first electrode of 1st lamp 223*a*.

The output terminal at the high voltage level of the secondary side of 2nd transformer T2 is connected to the input side, i.e., first electrode, of 2nd lamp 223*b*. A 2nd ballast capacitor C2 for stabilizing the current of 2nd lamp 223*b* is interposed between the output terminal at the high voltage level of the secondary side of 2nd transformer T2 and first electrode of 2nd lamp 223*b*.

On the other hand, the output sides, i.e., second electrode 223*c*, of 1st and 2nd lamps 223*a* and 223*b* are directly connected to each other on the electrical basis. Also, respective output terminals T1*a* and T2*a* at the low voltage level of the secondary sides of 1st and 2nd transformers T1 and T2 are directly connected to a stabilizing circuit 227 formed by a capacitor and a resistor within 5th inverter INV5. That is, the feedback current for stabilizing the current of 1st and 2nd lamps 223*a* and 223*b* is supplied via the output terminals at the low voltage level of the secondary sides of 1st and 2nd transformers T1 and T2.

In the same manner, the output terminal at the high voltage level of the secondary side of 3rd transformer T3 is connected to the first electrode of 3rd lamp 225*a*. A 3rd ballast capacitor C1 for stabilizing the current of 3rd lamp 225*a* is interposed between the output terminal at the high voltage level of the secondary side of 3rd transformer T3 and first electrode of 3rd lamp 225*a*.

The output terminal at the high voltage level of the secondary side of 4th transformer T4 is connected to the first electrode of 4th lamp 225*b*. A 4th ballast capacitor C4 for stabilizing the current of 4th lamp 225*b* is interposed between the output terminal at the high voltage level of the secondary side of 4th transformer T4 and first electrode of 4th lamp 225*b*.

Furthermore, second electrodes 225*c* of 3rd and 4th lamps 225*a* and 225*b* are directly connected to each other on the electrical basis. Respective output terminals T3*a* and T4*a* at the low voltage level of the secondary sides of 3rd and 4th transformers T3 and T4 are directly connected to stabilizing circuit 229 within 5th inverter INV5 to supply the feedback current for stabilizing the current of 3rd and 4th lamps 225*a* and 225*b* to stabilizing circuit 229.

Referring to FIG. 9, 1st controller CT1 is provided at the preceding stage of 1st and 2nd transformers T1 and T2. 1st controller CT1 includes first and second bias resistors R1 and R2 of which one ends are parallel connected with an input terminal of an external signal connected to 1st and 2nd transformers T1 and T2. Also included as parts are a first transistor Q1 having a base terminal connected to the other end of first bias resistor R1 to be commonly connected to 1st transformer T1, an emitter terminal grounded and a collector terminal connected to 1st and 2nd transformers T1 and T2, and a second transistor Q2 having a base terminal commonly connected to 1st transformer T1 with the other end of second bias resistor R2, an emitter terminal commonly grounded with the emitter terminal of 1st transistor Q1 and a collector terminal connected to 1st transformer T1. In addition to these, an oscillating capacitor C5 has one end connected to 1st transformer T1 to be commonly with the collector terminal of 2nd transistor Q2, and the other end connected to the collector terminal of first transistor Q1. 1st controller CT1 having the above-described construction operates as a Royer circuit for converting the externally-supplied DC signal into the AC signal.

Meanwhile, the first electrodes of 1st and 2nd lamps 223*a* and 223*b* are respectively connected to the output terminals at the high voltage level of 1st and 2nd transformers T1 and T2 via 1st and 2nd ballast capacitors C1 and C2. At this time, the output terminals at the high voltage level of 1st and 2nd transformers T1 and T2 respectively connected to the first electrodes of 1st and 2nd lamps 223*a* and 223*b* have the coils wound in the reverse direction opposite to each other.

In more detail, the output terminal at the high voltage level of 1st transformer T1 electrically connected to the first electrode of 1st lamp 223*a* is set as the starting point of wiring the coil. Whereas the output terminal at the high voltage level of 2nd transformer T2 electrically connected to the first electrode of 2nd lamp 223*b* is set as the ending point of wiring the coil.

Therefore, the AC signals respectively applied to 1st lamp 223*a* and 2nd lamp 223*b* from 1st and 2nd transformers T1 and T2 have a phase difference of 180° from each other. At this time, the output terminals at the low voltage level of the secondary sides of 1st and 2nd transformers T1 and T2 directly connected to stabilizing circuit 227 on the electrical basis supply the feedback current for stabilizing the current flowing through 1st and 2nd lamps 223*a* and 223*b* to respective 1st and 2nd lamps 223*a* and 223*b*.

When the phase difference of the AC signals respectively supplied to 1st and 2nd lamps 223*a* and 223*b* is 180° from each other as stated above, a virtually zero voltage is generated at the second electrodes portion of 1st and 2nd lamps 223*a* and 223*b* which are directly connected on the electrical basis.

Accordingly, as shown in FIG. 10, a potential difference is generated between the first electrode and second electrode of 1st lamp 223*a* at the portions denoted by reference alphabets "A" and "B" to allow 1st and 2nd lamps 223*a* and 223*b* to carry out the light emitting operation.

Figure 1:
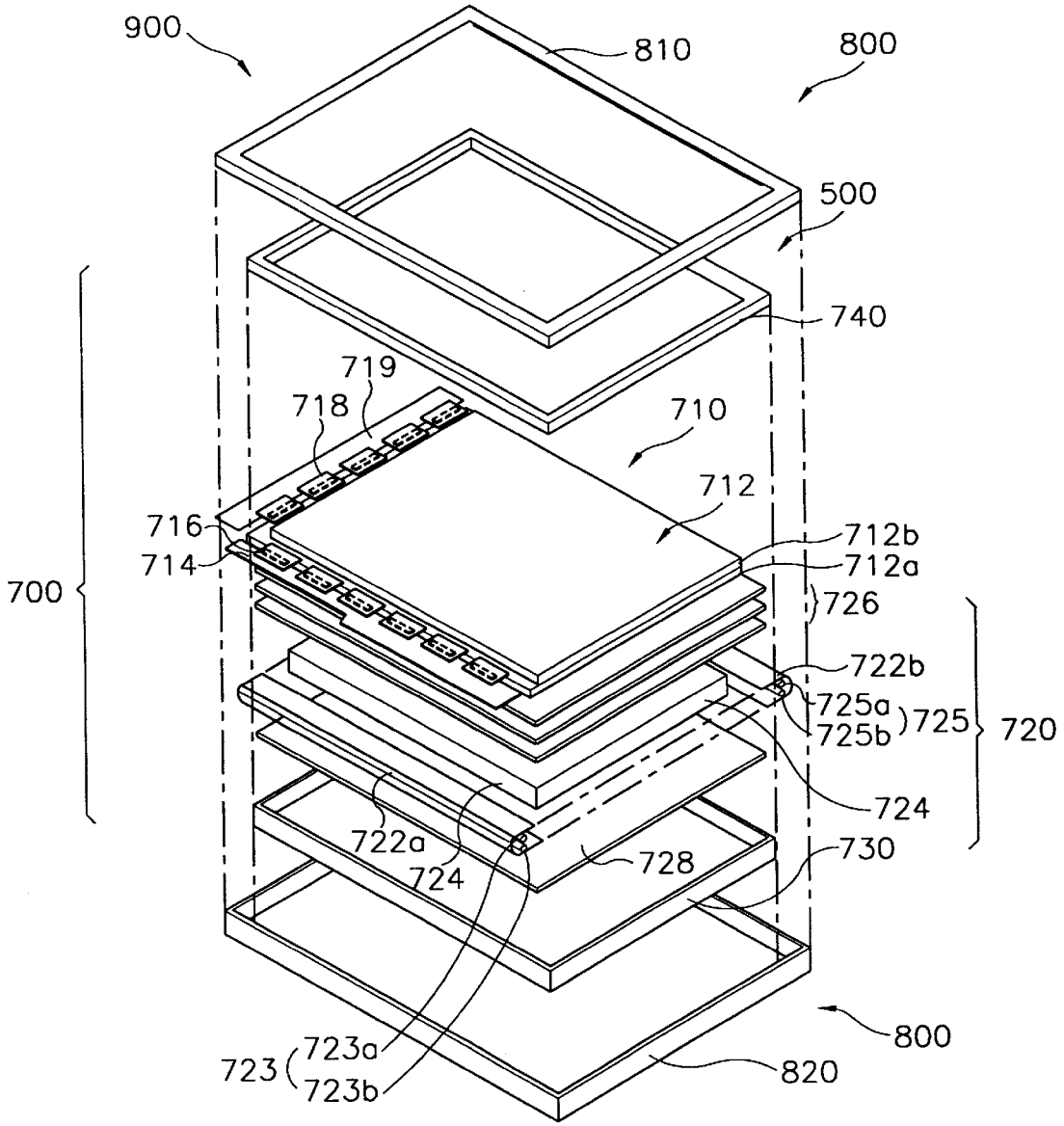
FIG. 1 (PRIOR ART)
FIG. 1 is an exploded perspective view schematically showing a conventional liquid crystal display device.
Figure 2:
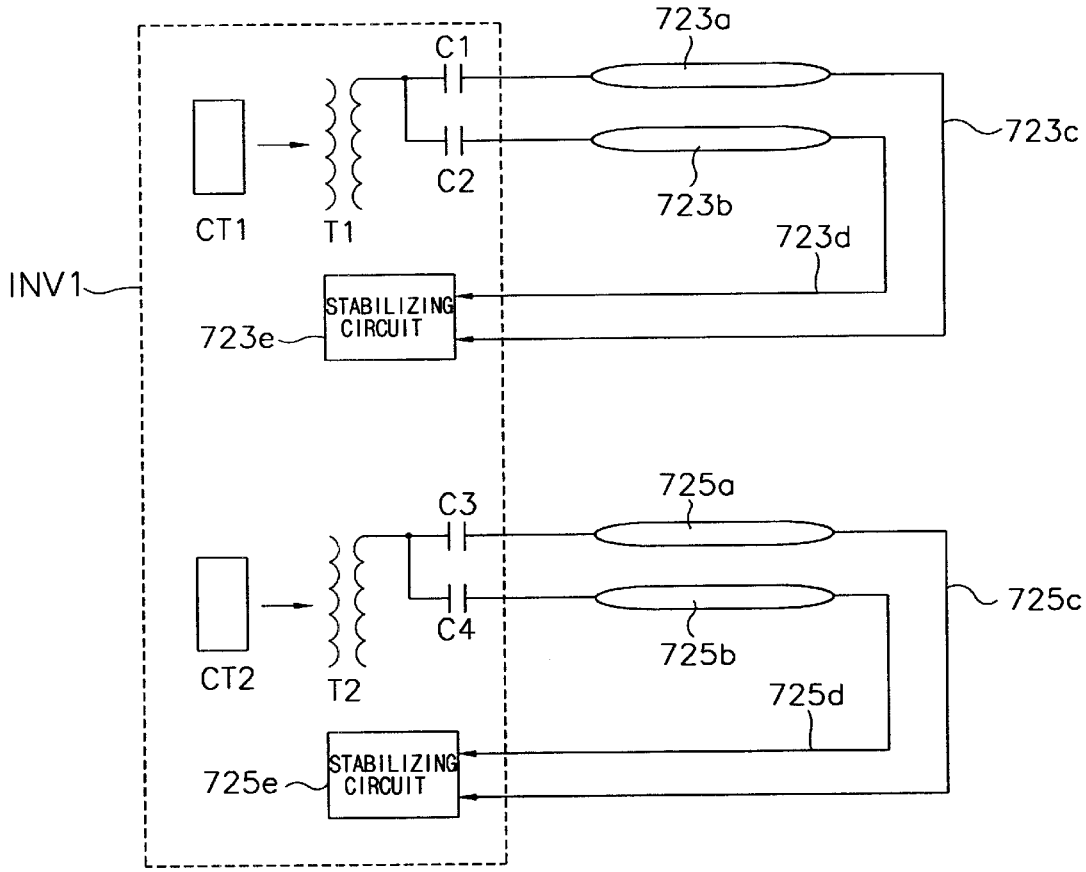
FIG. 2 (PRIOR ART)
FIG. 2 is a circuit diagram showing a configuration of lamps of the backlight assembly shown in FIG. 1 and an inverter module for driving the lamps in more detail.
Figure 3:
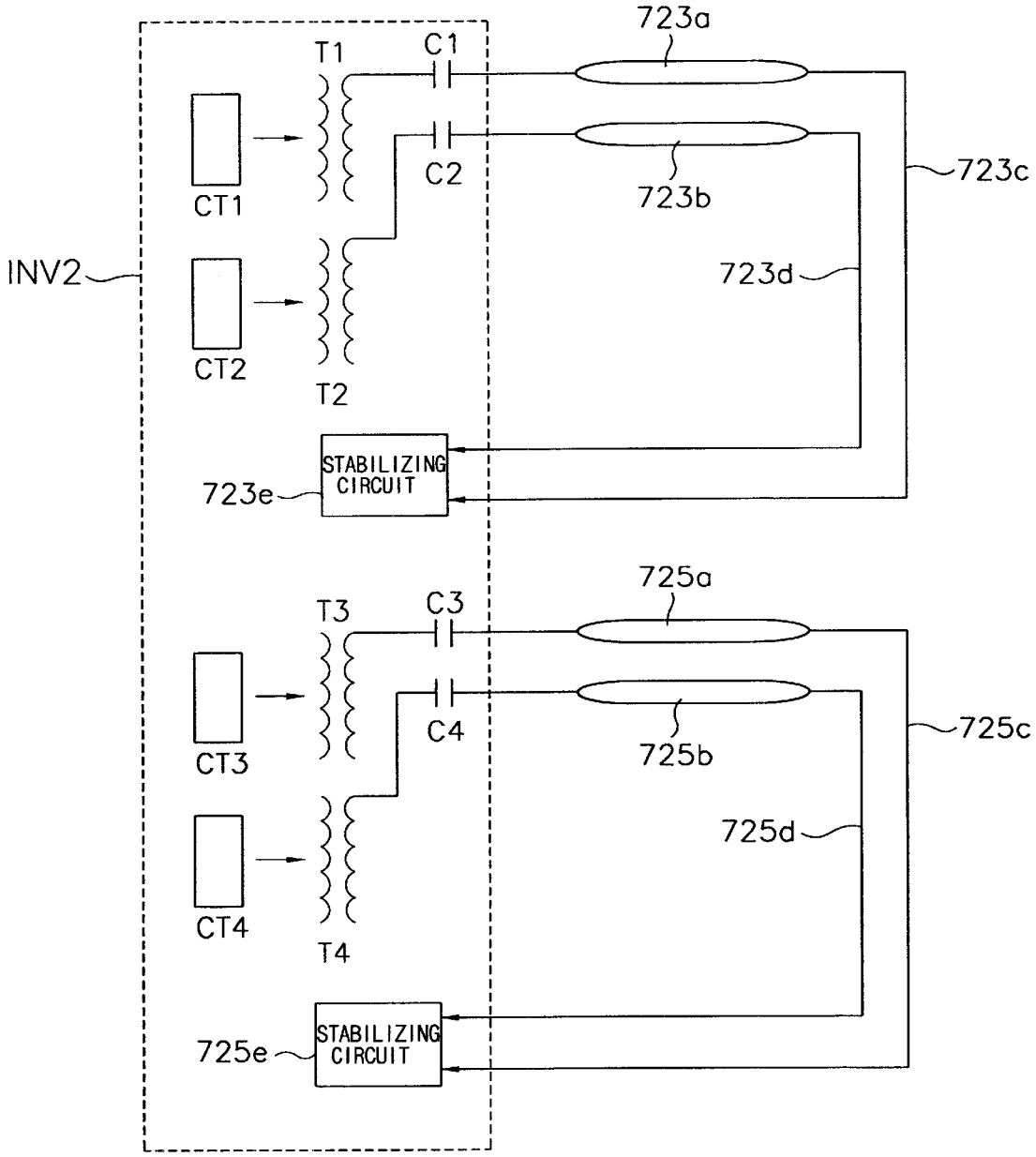
FIG. 3 (PRIOR ART)
FIG. 3 is a circuit diagram showing another example of the configuration of the lamps of the backlight assembly shown in FIG. 1 and inverter module.
Figure 4:
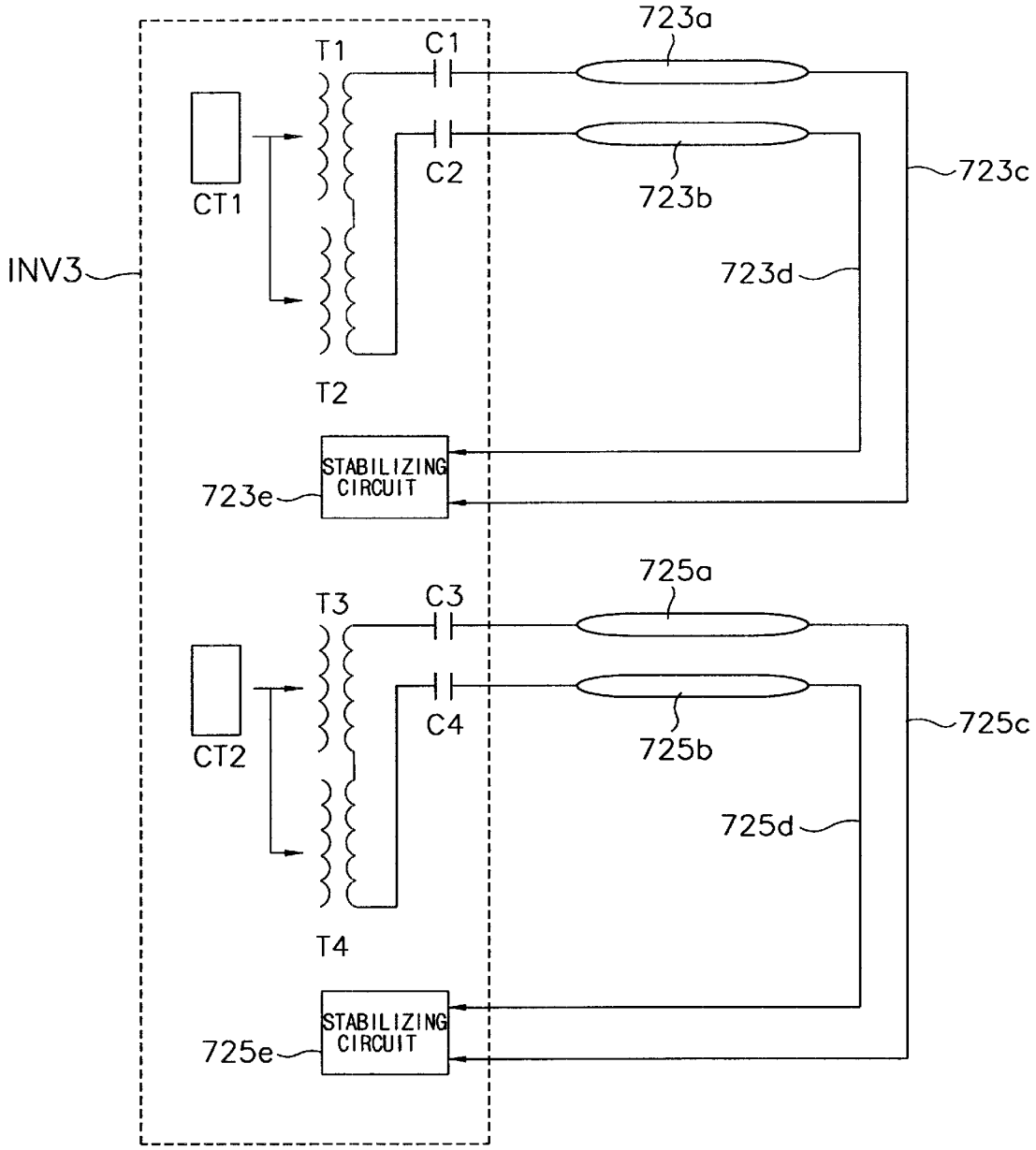
FIG. 4 (PRIOR ART)
FIG. 4 is a circuit diagram showing still another example of the configuration of the lamps of the backlight assembly shown in FIG. 1 and inverter module.
Figure 5A:
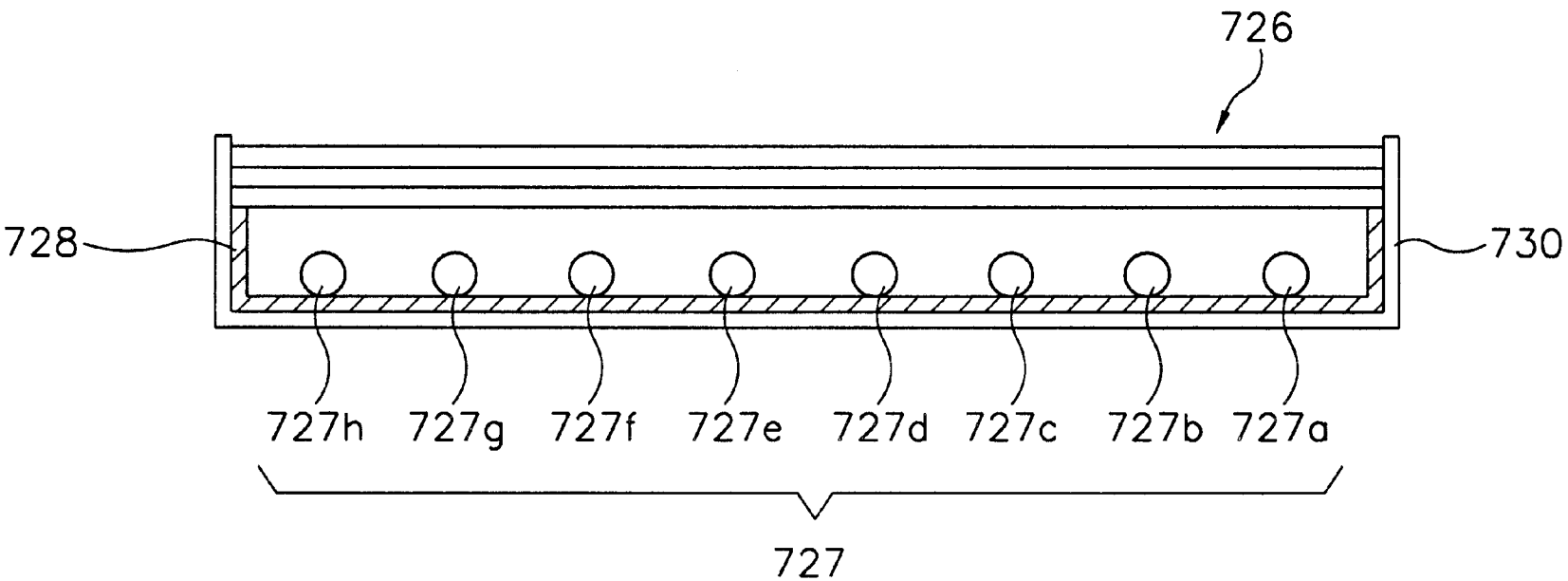
FIG. 5A (PRIOR ART)
FIGS. 5A and 5B are views showing the configuration of the lamps and inverter module of a direct-type liquid crystal display device.
Figure 5B:
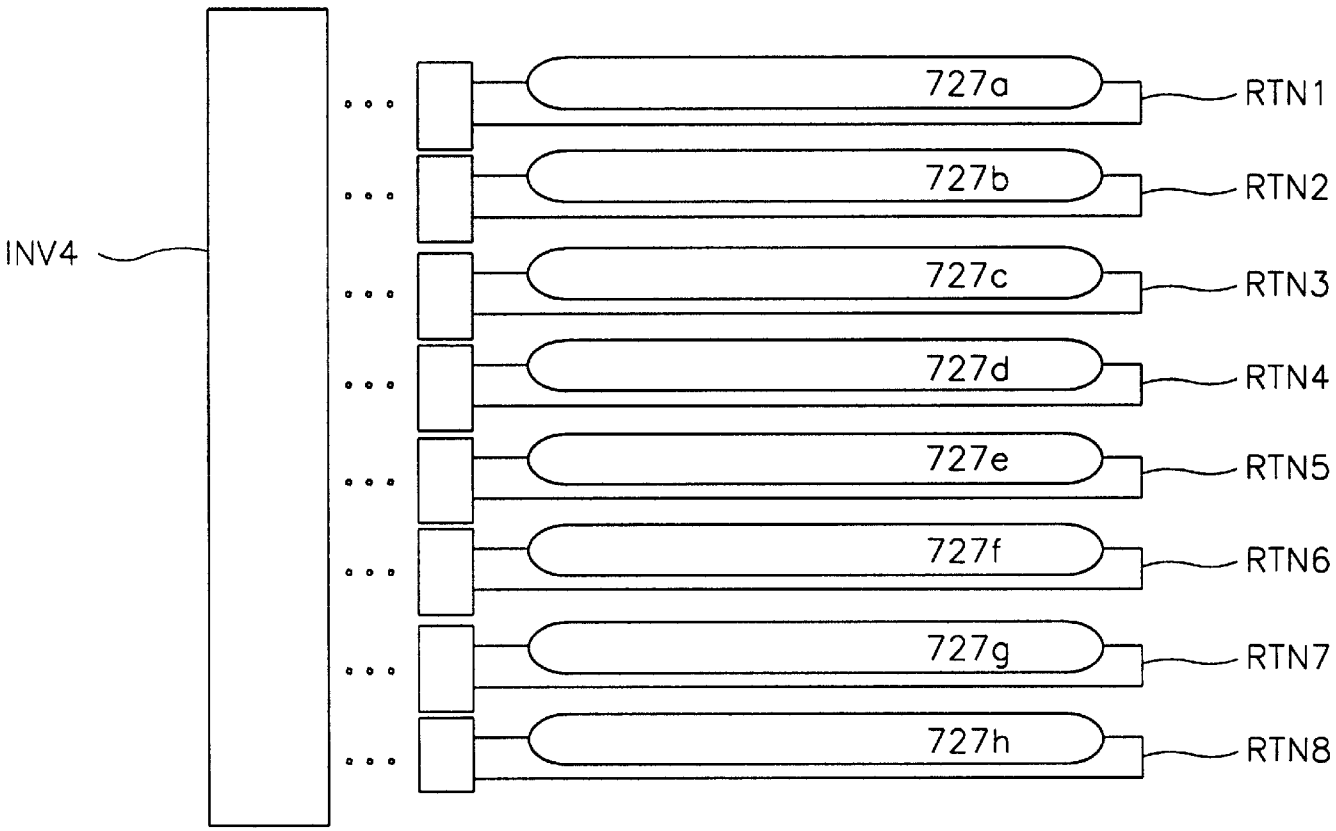
FIG. 5B (PRIOR ART)

The following Table 2 represents the operational characteristics of the conventional lamp driving system as shown in FIG. 4 and the lamp driving system according to the present invention as shown in FIG. 8.

Referring to Table 2, the conventional driving system shown in FIG. 4 and driving system according to the present invention shown in FIG. 8 have little difference in terms of the power dissipation of the inverter and leakage current of the lamp. In view of the luminance of the backlight, they show similar luminance at the current values of respective lamps.

TABLE 2

| Respective | Backlight Luminance (nits) | | Inverter Power Dissipation (W) | | Lamp Leakage Current (mArms) | |
|---|---|---|---|---|---|---|
| Lamp Current (mArms) | Prior Art (FIG. 4) | Present Invention (FIG. 8) | Prior Art (FIG. 4) | Present Invention (FIG. 8) | Prior Art (FIG. 4) | Present Invention (FIG. 8) |
| 6.0 | 1965 | 1958 | 19.3 | 19.3 | 1.3 | 1.3 |
| 5.0 | 1785 | 1778 | 17.2 | 17.2 | 1.7 | 1.7 |
| 4.0 | 1545 | 1545 | 15.1 | 15.2 | 2.2 | 2.2 |

When considering the result of measuring, the conventional lamp driving system as shown in FIG. 4 and the lamp driving system according to the present invention as shown in FIG. 8 display the similar result in the backlight luminance, power dissipation of the inverter and leakage current of the lamp. However, in the lamp driving system according to the present invention as shown in FIG. 8, the second electrodes of respective lamps are not connected to the stabilizing circuit within the interior of the inverter unlike the conventional lamp driving system. Instead, the second electrodes are directly connected to each other on the electrical basis. This reduces the space occupied by the wiring of the RTN as well as the manufacturing cost of the LCD device.

On the other hand, as shown in FIG. 7, because two driving signals are utilized when two lamps are arranged up and down, the driving signals respectively applied to 1st and 2nd lamps 223*a* and 223*b* has the phase difference of 180° from each other. However, the number of lamps may be further increased as required. In this case, the phase of the driving signals supplied to the lamps is variably set in accordance with the number of lamps. FIGS. 11, 12, 13 and 14 show another examples of the construction of the lamps shown in FIG. 7.

Figure 11:
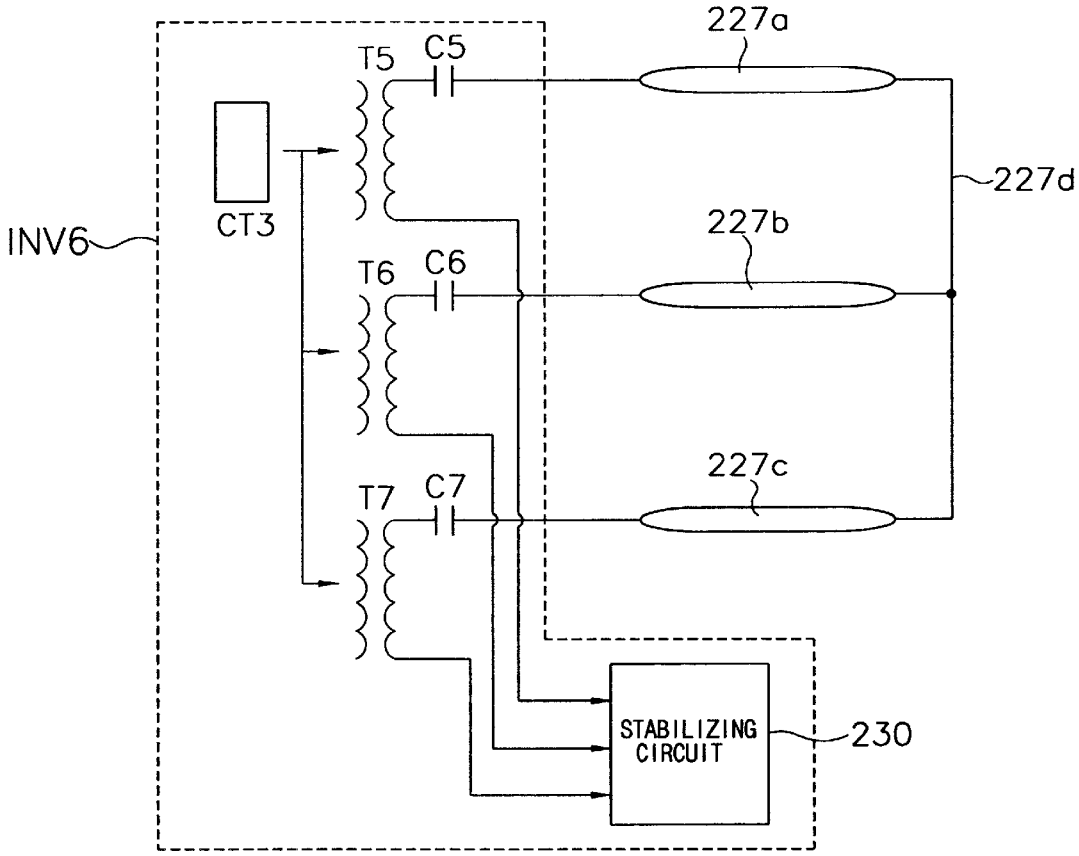
FIG. 11 is a circuit diagram showing a second embodiment of the configuration of the lamps of the backlight assembly shown in FIG. 6 and inverter module for driving the lamps.

Referring to FIG. 11, the backlight assembly employs three lamps, i.e., 5th, 6th and 7th lamps 227*a*, 227*b* 227*c*, as the light source of backlight. A 6th inverter INV6 for driving 5th, 6th and 7th lamps 227*a*, 227*b* and 227*c* has the transformers, i.e., 5th, 6th and 7th transformers T5, T6 and T7, numbering the same as the number of 5th, 6th and 7th lamps 227*a*, 227*b* and 227*c*. 5th, 6th and 7th transformers T5, T6 and T7 are driven by the driving signals from 3rd controller CT3.

The connection of 5th, 6th and 7th transformers T5, T6 and T7 and 5th, 6th and 7th lamps 227*a*, 227*b* and 227*c* is the same as that of two lamps. More specifically, the output terminals at the high voltage level of the secondary sides of 5th, 6th and 7th transformers T5, T6 and T7 are respectively connected to the first electrodes of 5th, 6th and 7th lamps 227*a*, 227*b* and 227*c*. 5th, 6th and 7th ballast capacitors C5, C6 and C7 for stabilizing the current of 5th, 6th and 7th lamps 227*a*, 227*b* and 227*c* are respectively interposed between the first electrodes of 5th, 6th and 7th lamps 227*a*, 227*b* and 227*c*and the output terminals at the high voltage level of the secondary sides of 5th, 6th and 7th transformers T5, T6 and T7. Additionally, the output terminals at the low voltage level of the secondary sides of 5th, 6th and 7th transformers T5, T6 and T7 are directly connected to stabilizing circuit 230 for stabilizing the current of 5th, 6th and 7th lamps 227*a*, 227*b* and 227*c* to supply the feedback current. Furthermore, the output sides, i.e., second electrodes, of 5th, 6th and 7th lamps 227*a*, 227*b* and 227*c* are directly connected to one another on the electrical basis.

Figure 12:
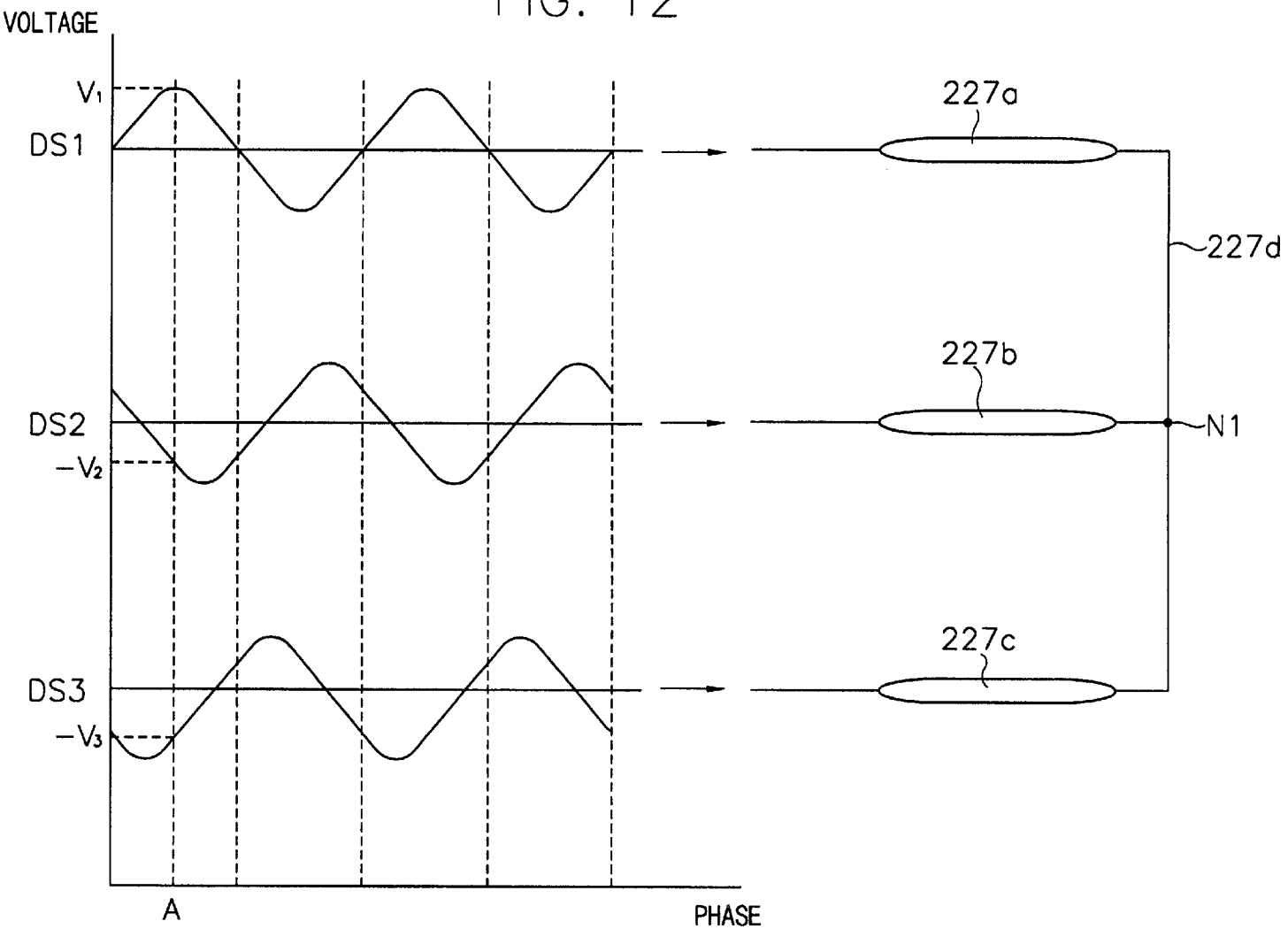
FIG. 12 is a view representing a phase difference of the driving signals supplied to respective lamps of the second embodiment shown in FIG. 11.

In case of forming by three lamps as described above, the phase difference of the driving signals supplied to respective lamps is determined by the number of lamps. As shown in FIG. 12, the driving signal supplied to 5th, 6th and 7th lamps 227*a*, 227*b* and 227*c* is provided to have a phase difference as many as a value obtained by diving 360° by the number of lamps. That is, if 1st driving signal DS1 supplied to 5th lamp 227*a* is provided in the form of a sine waveform starting from zero degree, 2nd driving signal DS2 supplied to 6th lamp 227*b* has a phase delayed as many as 120° from 1st driving signal DS1 and 3rd driving signal DS3 supplied to 7th lamp 227chas a phase delayed as many as 120° from 2nd driving signal DS2.

Therefore, the sum of the voltage values at respective phases of 1st, 2nd and 3rd driving signals DS1, DS2 and DS3 is always zero. For example, in FIG. 12, phases of 1st, 2nd and 3rd driving signals DS1, DS2 and DS3 at a point denoted by a reference alphabet "A" are 90°, −210° and −330° when viewed from 1st driving signal DS1 as a reference. If it is converted into the voltage value at the corresponding phase, respective voltage values of 1st, 2nd and 3rd driving signals DS1, DS2 and DS3 can be denoted by V1, −V2 and −V3. Therefore, the sum of the voltage values at respective phases of 1st, 2nd and 3rd driving signals D1, D2 and D3 in the output side of connecting respective second electrodes of 5th, 6th and 7th lamps 227*a*, 227*b* and 227*c* becomes zero to drive 5th, 6th and 7th lamps 227*a*, 227*b* and 227*c*.

Figure 13:
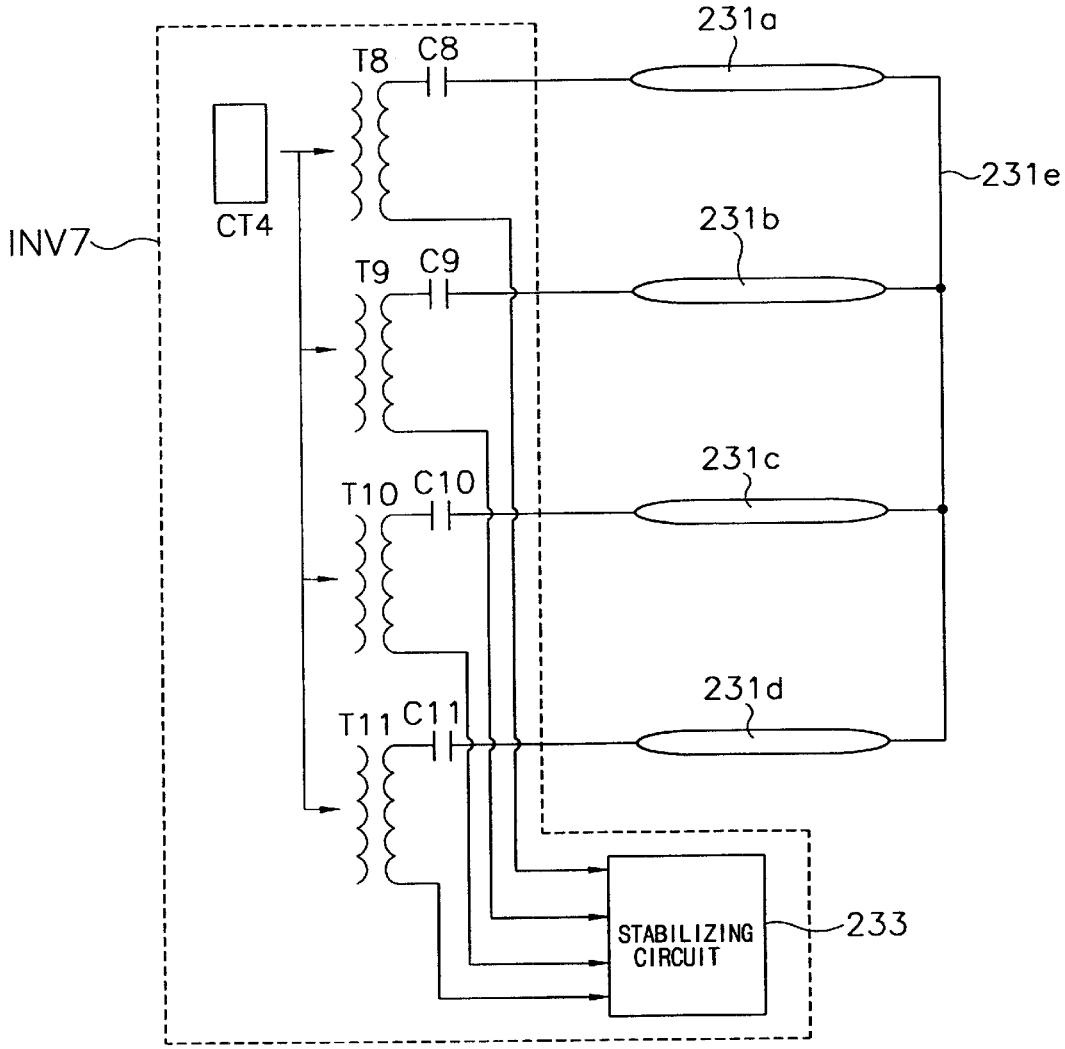
FIG. 13 is a circuit diagram showing a third embodiment of the configuration of the lamps of the backlight assembly shown in FIG. 6 and inverter module for driving the lamps.
Figure 14:
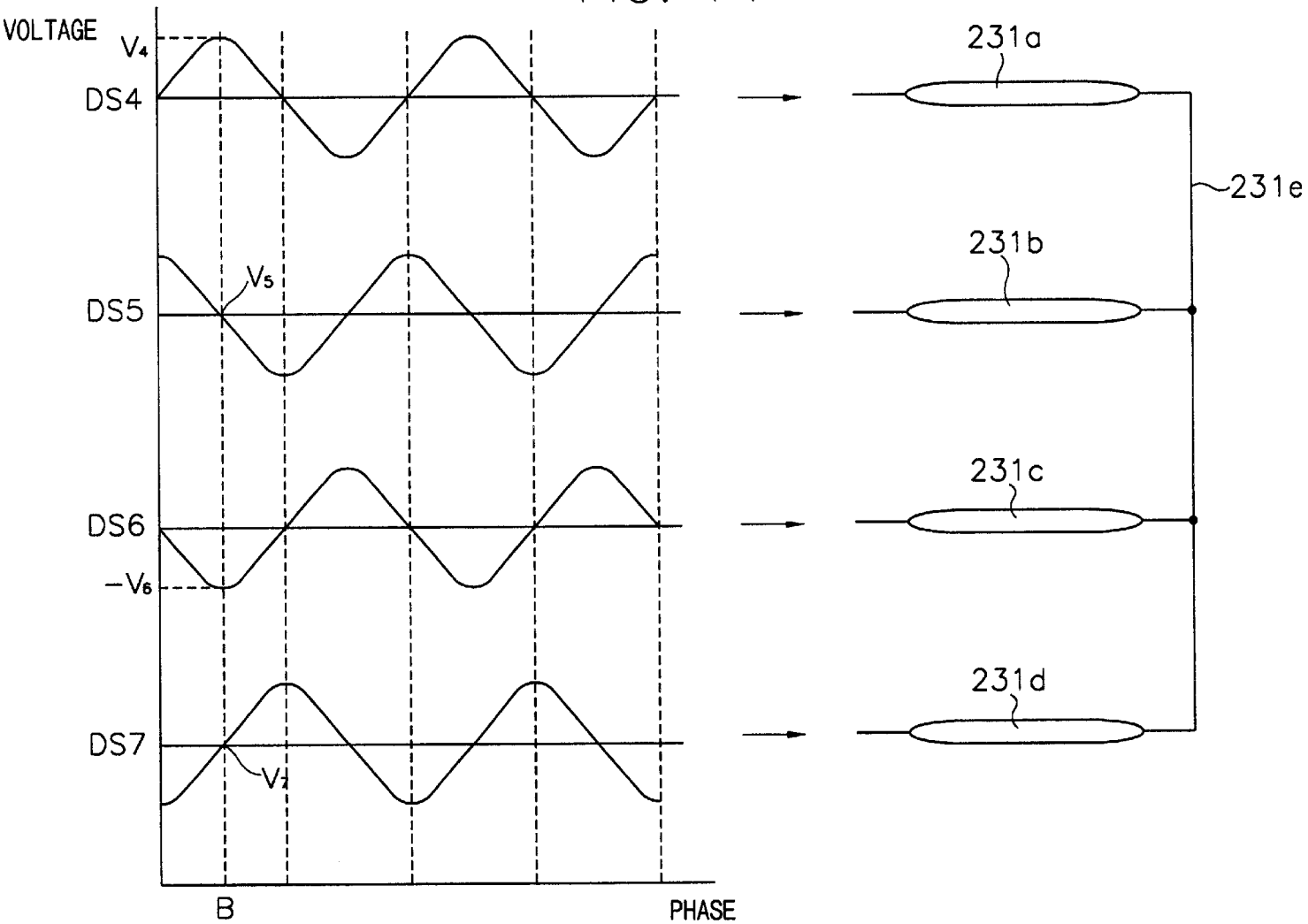
FIG. 14 is a view representing a phase difference of the driving signals supplied to respective lamps according to the third embodiment shown in FIG. 13.

FIG. 13 shows an example of employing four lamps, i.e., 8th, 9th, 10th and 11th lamps 231*a*, 231*b*, 231*c* and 231*d*, as the light source of the backlight assembly. FIG. 14 shows the phase difference of 4th, 5th, 6th and 7th driving signals DS4, DS5, DS6 and DS7 respectively supplied to 8th, 9th, 10th and 11th lamps 231*a*, 231*b*, 231*c* and 231*d*.

As illustrated, a 7th inverter INV7 for driving 8th, 9th, 10th and 11th lamps 231*a*, 231*b*, 231*c* and 231*d* has 8th, 9th, 10th and 11th transformers T8, T9, T10 and T11 numbering the same as the number of 8th, 9th, 10th and 11th lamps 231*a*, 231*b*, 231*c* and 231*d*. 8th, 9th, 10th and 11th transformers T8, T9, T10 and T11 are driven by 4th, 5th, 6th and 7th driving signals DS4, DS5, DS6 and DS7 from a 4th controller CT4.

In the same manner, the output terminals at the high voltage level of the secondary sides of 8th, 9th, 10th and 11th transformers T8, T9 T10 and T11 are connected to the first electrodes of 8th, 9th, 10th and 11th lamps 231*a*, 231*b*, 231*c* and 231*d*. 8th, 9th, 10th and 11th ballast capacitors C8, C9, C10 and C11 for stabilizing the current of 8th, 9th, 10th and 11th lamps 231*a*, 231*b*, 231*c* and 231*d* are respectively interposed between the first electrodes of 8th, 9th, 10th and 11th lamps and output terminals at the high voltage level of the secondary sides of 8th, 9th, 10th and 11th transformers T8, T9, T10 and T11. Also, the output terminals at the low voltage level of the secondary sides of 8th, 9th, 10th and 11th transformers T8, T9, T10 and T11 are directly connected to a stabilizing circuit 233 for stabilizing the current of 8th, 9th, 10th and 11th lamps 231*a*, 231*b*, 231*c* and 231*d* to supply the feedback current. The output sides, i.e., second electrodes, of 8th, 9th, 10th and 11th lamps 231*a*, 231*b*, 231*c* and 231*d* are directly connected to one another on the electrical basis.

In case of forming by four lamps as described above, the phase difference of the driving signals supplied to respective lamps is determined by the number of lamps. As shown in FIG. 14, 4th, 5th, 6th and 7th driving signals DS4, DS5, DS6 and DS7 supplied to 8th, 9th, 10th and 11th lamps 231*a*, 231*b*, 231*c* and 231*d* are supplied to have the phase difference having a value of dividing 360° by the number of lamps. In describing with reference to FIG. 14, if 4th driving signal DS4 supplied to 8th lamp 231*a* is provided in the form of the sine waveform starting from zero degree, 5th driving signal DS5 supplied to 9th lamp 231*b* has a phase delayed by 90° from 4th driving signal DS4. Then, 6th driving signal DS6 supplied to 10th lamp 231*c* has a phase delayed by 90° from 5th diving signal DS5, and 7th driving signal DS7 supplied to 11th lamp 231*d* has a phase delayed by 90° from 6th driving signal DS6.

Therefore, the sum of respective phases of 4th, 5th, 6th and 7th driving signals DS4, DS5, DS6 and DS7 is always zero. For example, in FIG. 14, the phases of 4th, 5th, 6th and 7th driving signals DS4, DS5, DS6 and DS7 are respectively 90°, 0°, −270° and 0° at the point of reference alphabet "B" from the point of supplying the signals. When these are converted into the voltage values at corresponding phases, 4th, 5th, 6th and 7th driving signals DS4, DS5, DS6 and DS7 respectively have voltage values of V4, V5, −V6 and V7. Consequently, the sum of the voltage values at respective phases of 4th, 5th, 6th and 7th driving signals D4, D5, D6 and D7 on the output sides of connecting respective second electrodes of 8th, 9th, 10th and 11th lamps 231*a*, 231*b*, 231*c* and 231*d* becomes zero to drive 8th, 9th, 10th and 11th lamps 231*a*, 231*b*, 231*c* and 231*d*.

While the number of lamps is two to four with reference to FIGS. 7 to 14 described hereinbefore, the connecting method of the lamps and transformers and method of deciding the phase difference of the driving signals supplied from the transformers to the lamps are identical even if the number of lamps is increased to four or more. In other words, since the driving signals supplied to respective lamps are provided in the sine waveform to have the phase difference obtained by dividing 360° by the number of overall lamps, the directly-connected second electrode sides of respective lamps has the voltage value of zero. Accordingly, the RTNs extending from the second electrodes of the lamps toward the inverter module side prior to being connected to the stabilizing circuit can be eliminated free from the number of lamps to make it possible to shrink overall size of the backlight assembly and economize the manufacturing cost.

Figure 15:
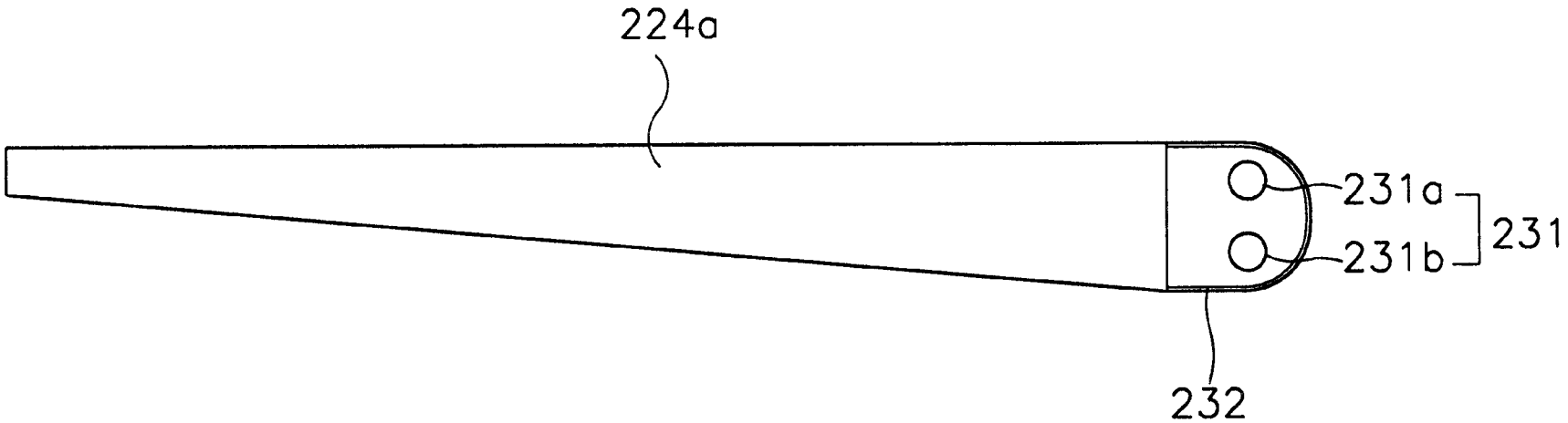
FIG. 15 is a sectional view showing another example of the sectional structure of the light guide plate and lamp unit shown in FIG. 6.

Meantime, the above-described lamp driving system may be identically applied to a wedge-type light guide plate 224*a* as shown in FIG. 15 as well as the edge-type LCD device in which the lamps are installed to both ends of light guide plate 224 as shown in FIG. 7.

In more detail, the second electrodes of 12th and 13th lamps 231*a*and 231*b* protected by a third lamp cover 232 on one end of wedge-type light guide plate 224*a* to be installed up and down are directly connected to each other on the electrical basis as shown in FIG. 8. Additionally, the first electrodes of 12th and 13th lamps 231*a*and 231*b* are, as shown in FIG. 8, respectively connected to the separate output terminals at the high voltage level of transformers, and the output terminals at the low voltage level of respective transformers are connected to the stabilizing circuit within the inverter. Consequently, in case of the wedge-type light guide plate 224*a* as shown in FIG. 15, the RTNs of 12th and 13th lamps 231*a*and 231*b* are also eliminated to obtain the same effect as of FIG. 8.

Figure 16:
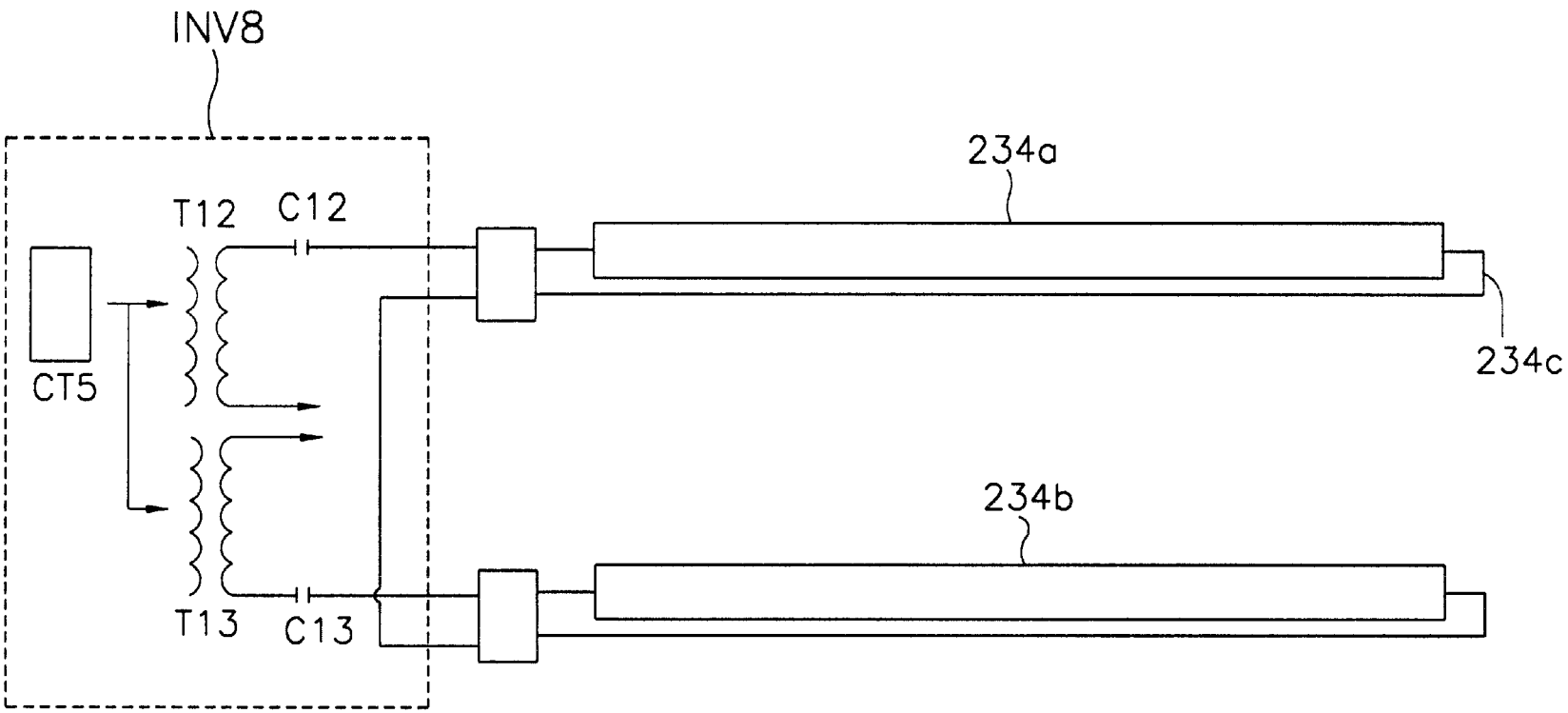
FIG. 16 is a view for showing a fourth embodiment of the configuration of the lamp of the backlight assembly shown in FIG. 6 and inverter module for driving the lamps.

FIG. 16 is a view showing another example of the configuration of the lamps of backlight assembly as shown in FIG. 6 and the inverter module for driving the same.

Respective second electrodes of the pairs of 1st & 2nd lamps 223*a* & 223*b* and 3rd & and 4th lamps 225*a* & 225*b* shown in FIG. 7 may be connected by extending long toward an 8th inverter INV8 side.

When giving 14th and 15th lamps 234*a* and 234*b* shown in FIG. 16 as an example, the first electrodes of 14th and 15th lamps 234*a* and 234*b* are connected to the output terminals at the high voltage level of the secondary sides of 12th and 13th transformers T12 and T13 respectively forming 8th inverter INV8. 12th and 13th ballast capacitors C12 and C13 for stabilizing the current of 14th and 15th lamps 234*a* and 234*b* are interposed between them.

The second electrode of 14th lamp 234*a* extends long to the interior of 8th inverter INV8, which in turn extends toward the second electrode side of 15th lamp 234*b* from the interior of 8th inverter INV8, thereby being directly connected to the second electrode of 15th lamp 124*b* on the electrical basis.

A stabilizing circuit (not shown) for stabilizing the current of 14th and 15th lamps 234*a* and 234*b* is furnished within the interior of 8th inverter INV8 as shown in FIG. 9. The feedback current supplied to the unshown stabilizing circuit for stabilizing the current of 14th and 15th lamps 234*a* and 234*b* is applied via the output terminals at the low voltage level of the secondary side of 12th and 13th transformers T12 and T13.

In the examples described hereinbefore, the second electrodes of the lamps employed to the backlight assembly of the LCD device shown in FIG. 6 are directly connected to each other, and the transformers of the inverter module numbers the same as the number of lamps to allow the first electrodes of the lamps to be supplied with the driving signals having the phase difference different from each other from the corresponding transformers. However, the plurality of lamps may be driven by using just two transformers regardless of the number of lamps in association with the combination of the electrodes of the plurality of lamps.

Figure 17:
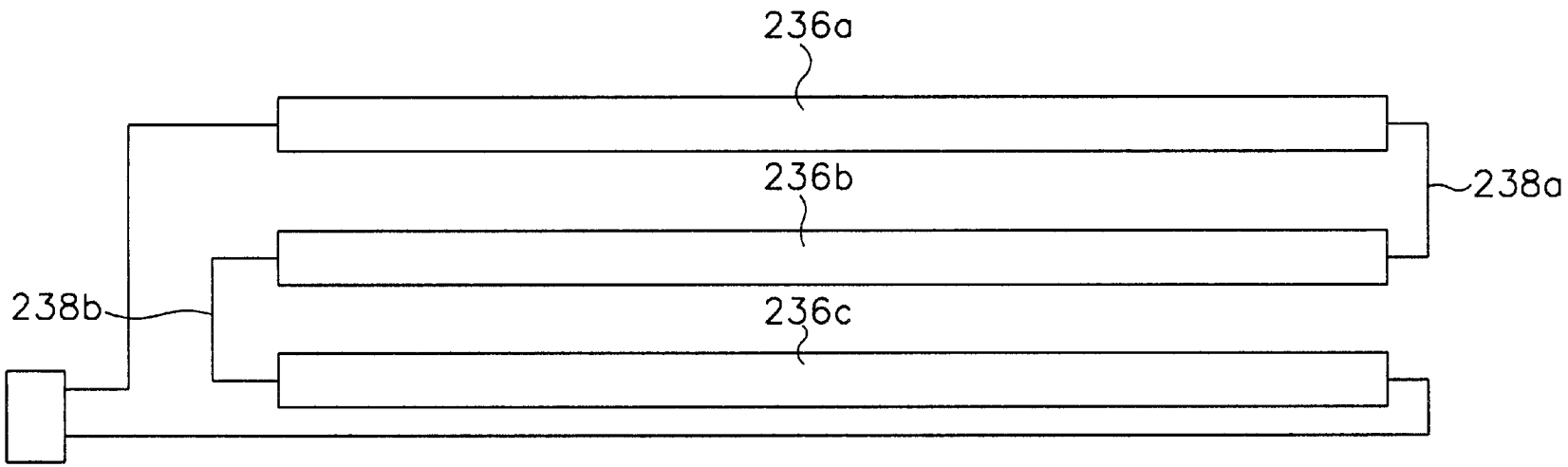
FIG. 17 is a view showing a fifth embodiment of the configuration of the lamps of the backlight assembly shown in FIG. 6 and inverter module for driving the lamps.
Figure 18:
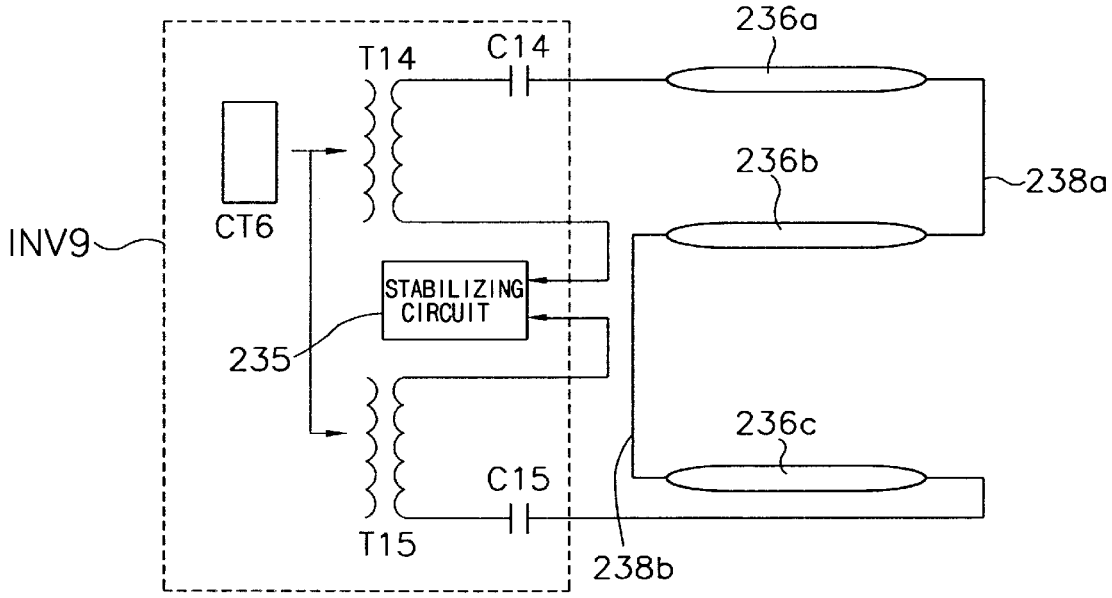
FIG. 18 is a circuit diagram showing the configuration of the lamps and inverter module according to the fifth embodiment shown in FIG. 17.
Figure 19:
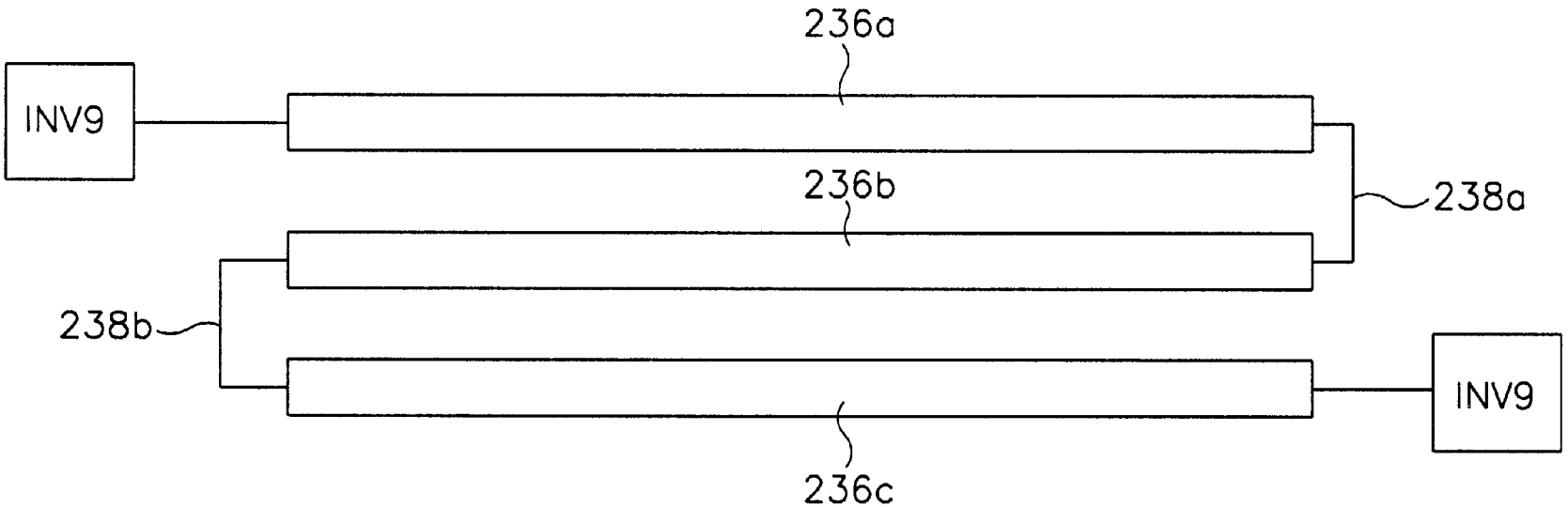
FIG. 19 is a view showing a modified example of the configuration of the lamps and inverter module according to the fifth embodiment shown in FIG. 17.

FIG. 17 is a view showing another example of the configuration of the lamps of the backlight assembly shown in FIG. 6 and the inverter for driving the same, which describes a case that the plurality of lamps are serially connected to one another. FIG. 18 is a circuit diagram more specifically showing the configuration of the lamp shown in FIG. 13 and the inverter module. FIG. 19 shows a modification of the configuration of the lamps shown in FIG. 13 and inverter module. If the plurality of lamps are serially connected, the circuit configuration may have the same form regardless of the number of lamps. Here, a case of utilizing three or four lamps is taken as an example for more detailed description.

As shown in FIGS. 17, 18 and 19, a 9th inverter INV9 has a 6th controller CT6 and 14th and 15th transformers T14 and T15 driven in response to the driving signals from 6th controller CT6. 15th, 16th and 17th lamps 236*a*, 236*b* and 236*c* are serially connected to one another, in which the first electrode of 15th lamp 236*a*and the first electrode of 17th lamp 236*c* are arranged to oppose to each other.

Thus, as shown in FIG. 18, the first electrode of 15th lamp 236*a*is connected to the output 20 terminal at the high voltage level of the secondary side of 14th transformer T14 by interposing a 14th ballast capacitor C14. Also, the first electrode of 17th lamp 236*a* extends long to 9th inverter INV9 side to be connected to the output terminal at the high voltage level of the secondary side of 15th transformer T15 by interposing 15th ballast capacitor C15 between them.

In the same manner, a stabilizing circuit 235 as shown in FIG. 9 is furnished within 9th inverter INV9. The output terminals at the low voltage level of the secondary sides of 14th and 15th transformers T14 and T15 are directly connected to stabilizing circuit 235, and the feedback current for stabilizing the current of 15th, 16th and 17th lamps 236*a*, 236*b* and 236*c* is supplied to stabilizing circuit 235 via the output terminals at the low voltage level of the secondary sides of 14th and 15th transformers T14 and T15.

At this time, the driving signals respectively supplied to the first electrodes of 15th and 17th lamps 236*a*and 236*c* from the output terminals at the high voltage level of the secondary sides of 14th and 15th transformers T14 and T15 via 14th and 15th ballast capacitors C14 and C15 have the phase difference of 180° from each other. This is because, even if the number of lamps is three, 15th, 16th and 17th lamps 236*a*, 236*b* and 236*c* are serially connected to one another, and just the first electrode of 15th lamp that is the most preceding lamp and the first electrode of 17th lamp 236*c* that is the finally succeeding lamp are respectively supplied with the driving signals from 14th and 15th transformers T14 and T15. In other words, when the plurality of lamps are serially connected, always two driving signals are utilized regardless of the number of lamps. For this reason, it is enough to maintain the phase difference of 180° between two driving signals.

In such a lamp driving system, 9th inverter INV9 for driving 15th, 16th and 17th lamps 236*a*, 236*b* and 236*c* is installed to any one side of 15th, 16th and 17th lamps 236*a*, 236*b* and 236*c* as illustrated. Due to this fact, the first electrode of 15th lamp 236*a*or the first electrode of 17th lamp 236*c* inevitably extends long toward 9th inverter INV9 side depending on the installing position of 9th inverter INV9.

However, when considering that the input stage of the lamps, i.e., first electrodes of 15th, 16th and 17th lamps 236*a*, 236*b* and 236*c*, for the backlight of the LCD device, as shown in FIG. 19, 14th and 15th transformers T14 and T15 forming 9th inverter INV9 may be separately arranged to place to be near to the first electrodes of 15th and 17th lamps 236*a*and 236*c*.

Figure 20:
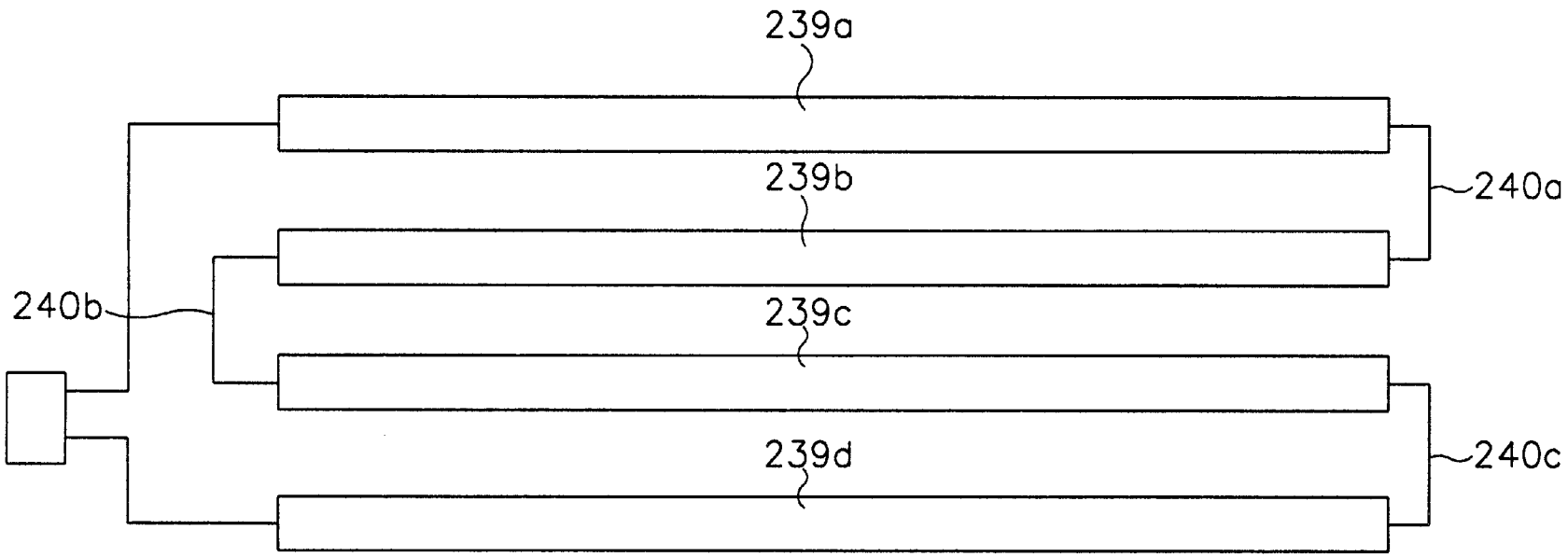
FIG. 20 is a view showing a sixth embodiment of the configuration of the lamps of the backlight assembly shown in FIG. 6 and inverter module for driving the lamps.
Figure 21:
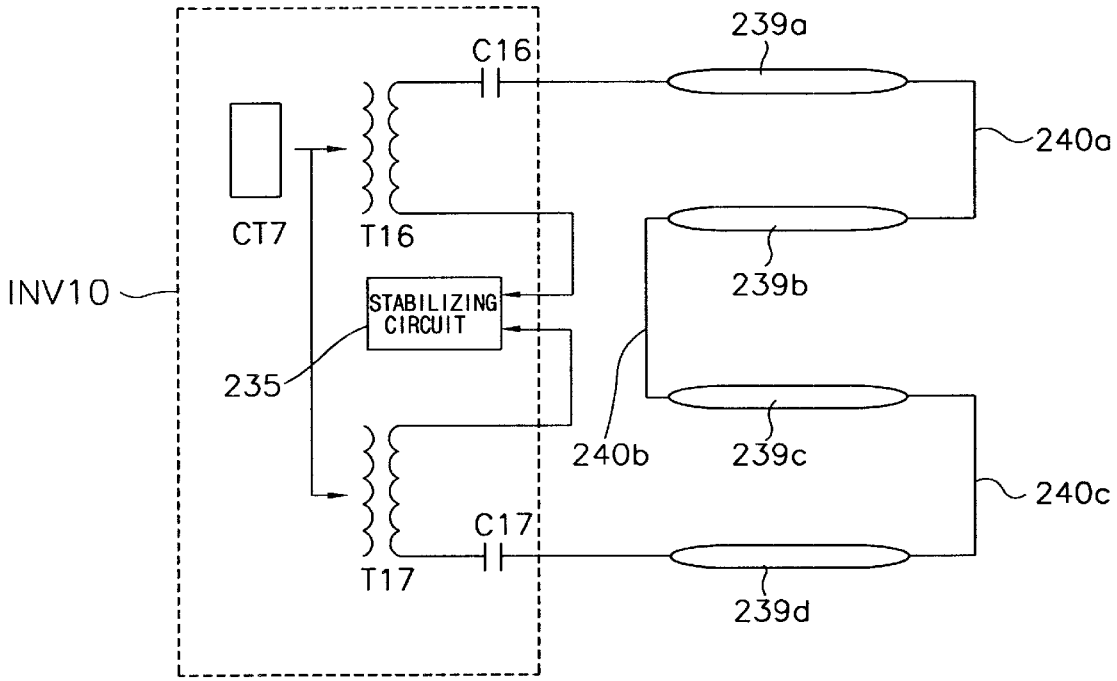
FIG. 21 is a circuit diagram showing the configuration of the lamps shown in FIG. 6 and inverter module according to the sixth embodiment in more detail.

FIGS. 20 and 21 show an example of serially connecting four lamps.

As shown in FIGS. 20 and 21, a 10th inverter INV10 has a 7th controller CT7, and 16th and 17th transformers T16 and T17 driven in response to the driving signal from 7th controller CT7. 18th, 19th, 20th and 21st lamps 239*a*, 239*b*, 239*c* and 239*d* are serially connected to one another, which are even-numbered. Accordingly, unlike the three lamps shown in FIG. 17, the first electrode of 18th lamp 239*a*and the first electrode of 21st lamp 239*d* are arranged in the same direction.

As shown in FIG. 21, the first electrode of 18th lamp 239*a* is connected to the output terminal at the high voltage level of the secondary side of 16th transformer T16 by interposing a 16th ballast capacitor C16. Also, the first electrode of 21st lamp 239*d* extends long toward 10th inverter INV10 side to be connected to the output terminal at the high voltage level of the secondary side of 17th transformer T17 by interposing a 17th ballast capacitor C17.

Similarly, a stabilizing circuit 235 as shown in FIG. 9 is furnished within 10th inverter INV10 as shown in FIG. 9. Also, the output terminals at the low voltage level of the secondary sides of 16th and 17th transformers T16 and T17 are directly connected to stabilizing circuit 235. The feedback current for stabilizing the current of 18th, 19th, 20 th and 21st lamps 239*a*, 239*b*, 239*c* and 239*d* is supplied to stabilizing circuit 235 via the output terminals at the low voltage level of the secondary sides of 16th and 17th transformers T16 and T17.

At this time, the driving signals respectively supplied to the first electrodes of 18th and 21st lamps 239*a* and 239*d* from the output terminals at the high voltage level of the secondary sides of 16th and 17th transformers T16 and T17 via 16th and 17th ballast capacitors C16 and C17 have the phase difference of 180° from each other. This is because, when the plurality of lamps are serially connected, just two driving signals are always utilized regardless of the number of lamps even if the lamps number four. Therefore, it is enough for two driving signals to maintain the phase difference of 180°.

Here, it is described by giving examples of three and four lamps which are serially connected to one another, but the driving signals are supplied to only the first electrode of the most preceding lamp and the first electrode of the finally succeeding lamp among the plurality of serially-connected lamps, even though the number of lamps increases to four or more. Therefore, by supplying the driving signals having the phase difference of 180° from each other to the first electrodes of the most preceding lamp and the finally succeeding lamp by using two transformers, the driving effect identical to the above-described case can be obtained.

Figure 22:
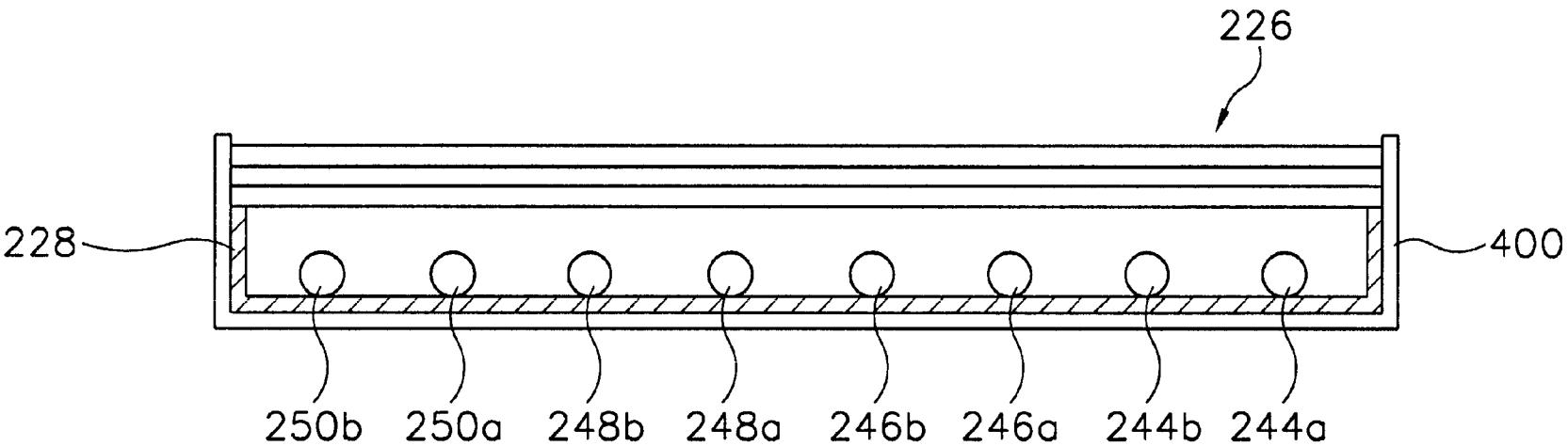
FIG. 22 is a sectional view showing the sectional structure of the lamp unit of the direct-type liquid crystal display device according to a preferred embodiment of the present invention.
Figure 23:
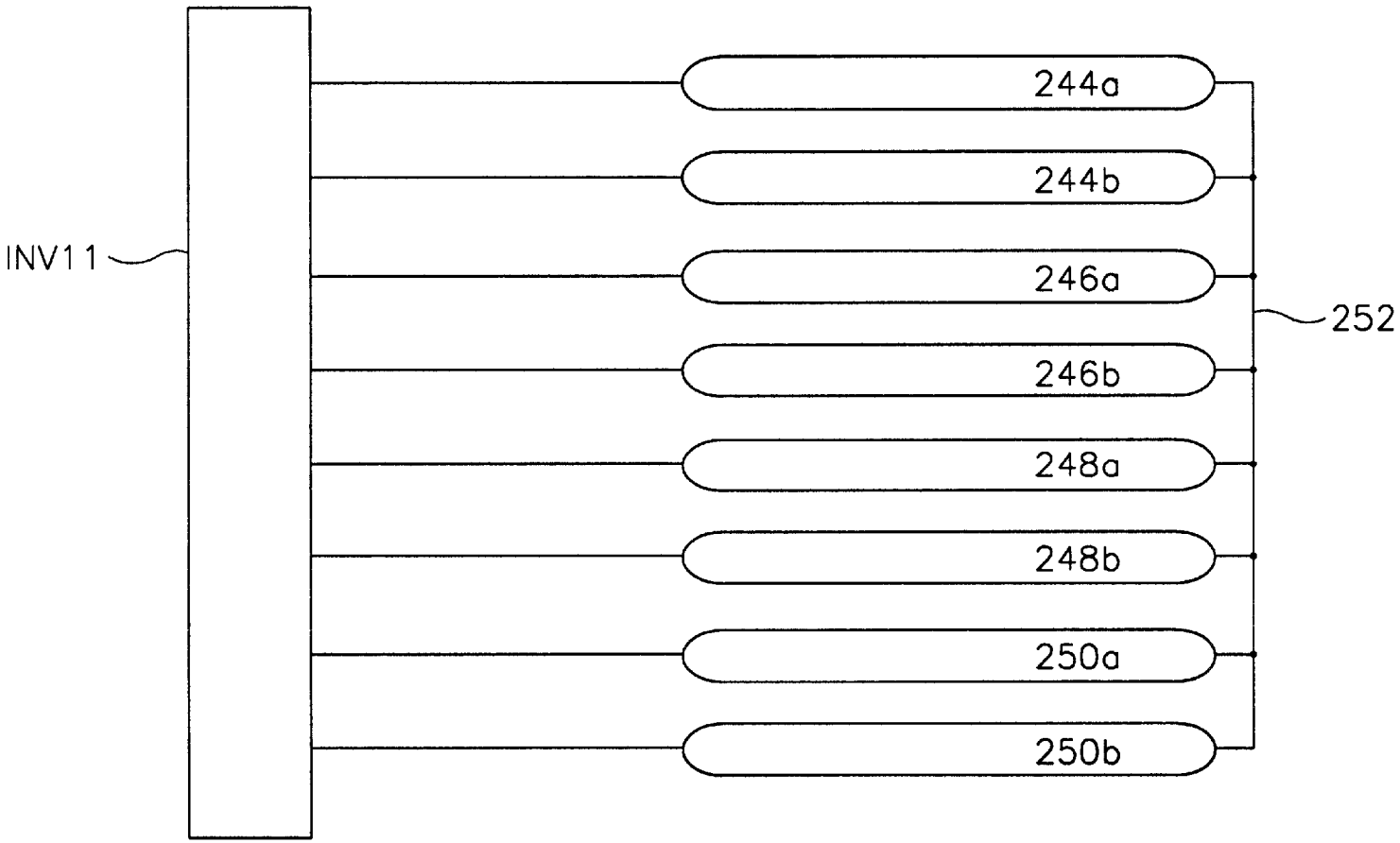
FIG. 23 is a view showing the configuration of the lamps shown in FIG. 22 and inverter module for driving the lamps.
Figure 24:
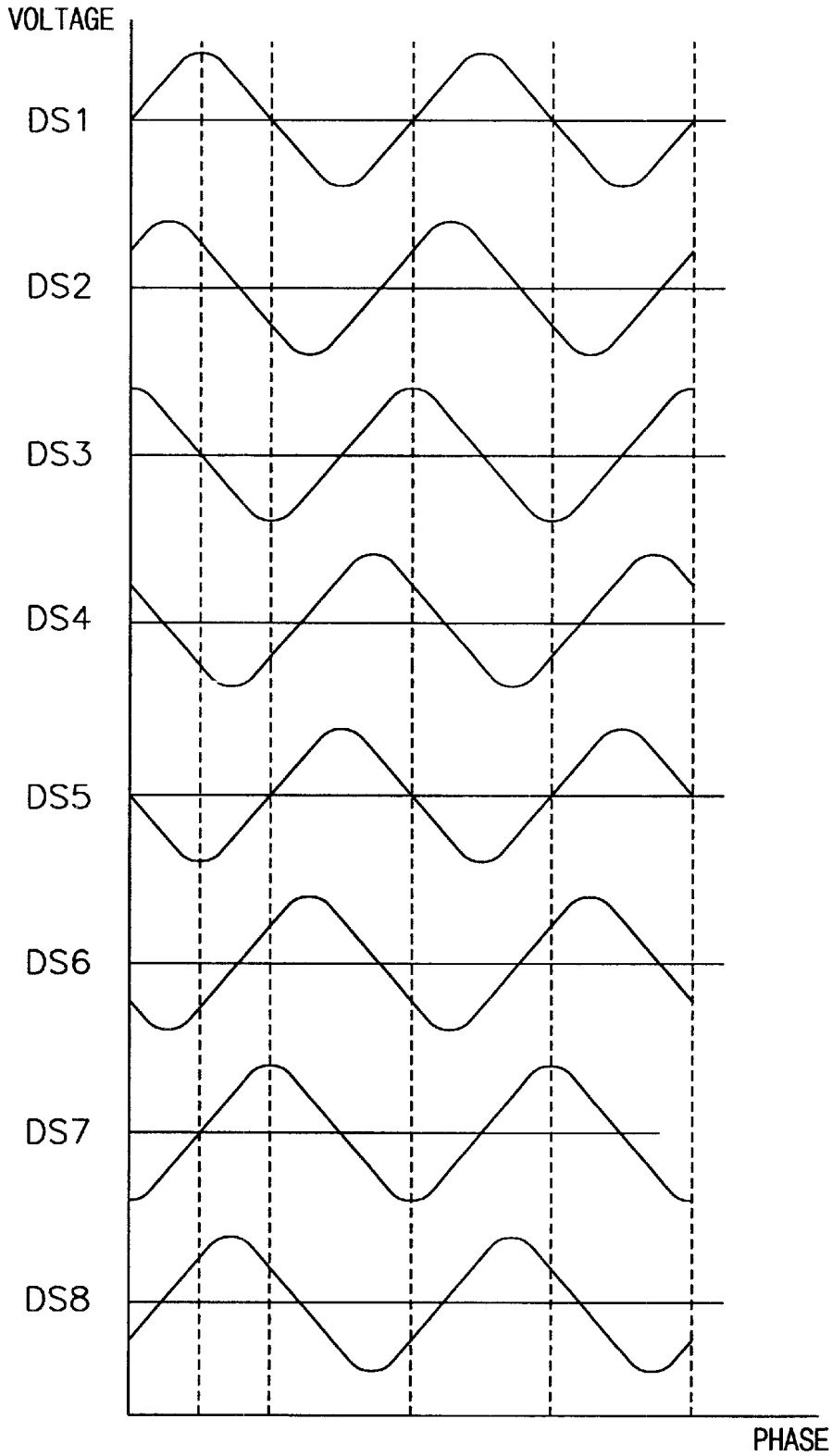
FIG. 24 is a view representing a phase difference of driving signals supplied to respective lamps shown in FIG. 23.
Figure 25:
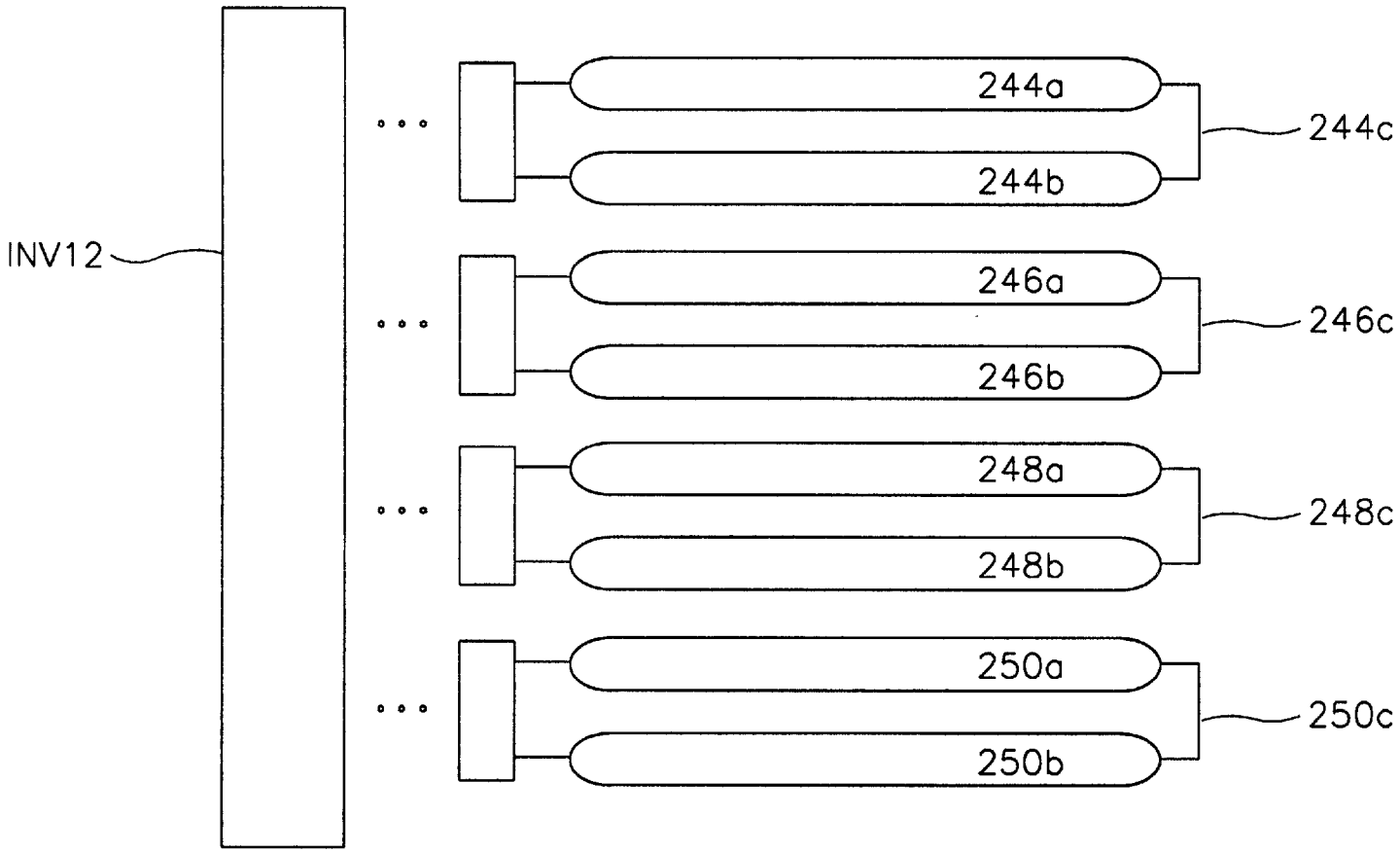
FIG. 25 is a view showing another example of the configuration of the lamps shown in FIG. 16 and inverter module for driving the lamps.

FIG. 22 is a sectional view showing the sectional structure of the lamp unit of the direct-type LCD device according to a preferred embodiment of the present invention. FIG. 23 is a view schematically showing the configuration of the lamps shown in FIG. 22 and inverter module for driving the same. FIG. 24 is a waveform for showing the waveforms of the driving signals supplied to respective lamps from the inverter module shown in FIG. 23. FIG. 25 is a view showing another example of the configuration of the lamps shown in FIG. 22 and inverter for driving the same.

As shown in FIG. 22, the direct-type LCD device is formed having a plurality of lamps 244*a*, 244*b*, 244*a*, 244*b*, 248*a*, 248*b*, 250*a* and 250*b* arranged to be separated from one another by a predetermined distance on the bottom plane of mold frame 400 by interposing reflecting plate 228. At this time, the LCD device utilizes no light guide plate 224 for guiding the side light source toward display unit 210 as in the edge-type LCD device as shown in FIG. 6 because lamps 244*a*, 244*b*, 244*a*, 244*b*, 248*a*, 248*b*, 250*a* and 250*b* provide the light source from the rear plane of display unit 210. Diffuision sheet members 226 as a light controlling unit for adjusting the luminance of the light and so on are coupled to the upper plane of lamps 244*a*, 244*b*, 244*a*, 244*b*, 248*a*, 248*b*, 250*a* and 250*b* by securing a predetermined space for advancing the light from lamps 244*a*, 244*b*, 244*a*, 244*b*, 248*a*, 248*b*, 250*a* and 250*b*.

By reflecting the foregoing structural characteristic, the direct-type LCD device shown in FIG. 22 can employ a plurality of lamps 244*a*, 244*b*, 244*a*, 244*b*, 248*a*, 248*b*, 250*a* and 250*b* as shown in FIG. 23. That is, it is easy to vary the number of lamps in accordance with the area of the LCD panel in the direct-type LCD device.

11th inverter INV11 shown in FIG. 23 employs the formation of 5th inverter INV5 as shown in FIG. 8, in which the coupling structure of the first electrodes of plurality of lamps 244*a*, 244*b*, 244*a*, 244*b*, 248*a*, 248*b*, 250*a* and 250*b* and the plurality of transformers (not shown) forming 11th inverter INV1 is identical to that of 1st, 2nd, 3rd and 4th lamps 223*a*, 223*b*, 225*a* and 225*b* and 5th inverter INV5 shown in FIG. 8. In other words, 11th inverter INV11 has the same number of transformers as the number of lamps 244*a*, 244*b*, 244*a*, 244*b*, 248*a*, 248*b*, 250*a* and 250*b*.

Additionally, the first electrodes of plurality of lamps 244*a*, 244*b*, 244*a*, 244*b*, 248*a*, 248*b*, 250*a* and 250*b* are connected to the output terminals at the high voltage level of the secondary sides of corresponding transformers among the plurality of transformers in 11th inverter INV11. Also, the second electrodes of plurality of lamps 244*a*, 244*b*, 244*a*, 244*b*, 248*a*, 248*b*, 250*a* and 250*b* are directly connected to one another on the electrical basis.

In the same manner, the output terminals at the low voltage level of the respective secondary sides of the plurality of transformers constituting 11th inverter INV11 are directly connected to a stabilizing circuit (not shown) furnished to the interior of 11th inverter INV11 to supply the feedback current for stabilizing the current of plurality of lamps 244*a*, 244*b*, 244*a*, 244*b*, 248*a*, 248*b*, 250*a* and 250*b* to the stabilizing circuit.

Here, 1st, 2nd, 3rd, 4th, 5th, 6th, 7th and 8th driving signals DS1, DS2, DS3, DS4, DS5, DS6, DS7 and DS8 respectively provided from the unshown plurality of transformers of 11th inverter INV11 to plurality of lamps 244*a*, 244*b*, 244*a*, 244*b*, 248*a*, 248*b*, 250*a* and 250*b* respectively have the phase difference different from one another as described with reference to FIGS. 11, 12, 13 and 14. In more detail, when being formed by eight lamps as illustrated, 1st, 2nd, 3rd, 4th, 5th, 6th, 7th and 8th driving signals DS1, DS2, DS3, DS4, DS5, DS6, DS7 and DS8 are supplied to have the phase difference of 360° divided by eight.

In describing the phase with reference to FIG. 24, first driving signal DS1 has the phase of zero degree at the supplying point of 1st, 2nd, 3rd, 4th, 5th, 6th, 7th and 8th driving signals DS1, DS2, DS3, DS4, DS5, DS6, DS7 and DS8. Similarly, 2nd, 3rd, 4th, 5th, 6th, 7th and 8th driving signals DS2, DS3, DS4, DS5, DS6, DS7 and DS8 respectively have the phase values of 45°, 90°, 135°, 0°, −225°, −270° and −315° when viewed from 1st driving signal DS1 as a reference. If these are converted into the voltage values at the corresponding phases, the sum of the voltage values of respective phases of 1st, 2nd, 3rd, 4th, 5th, 6th, 7th and 8th driving signals DS1, DS2, DS3, DS4, DS5, DS6, DS7 and DS8 on the output sides connected to the second electrodes of plurality of lamps 244*a*, 244*b*, 244*a*, 244*b* 248*a*, 248*b*, 250*a* and 250*b* become zero. Consequently, the sum of the voltage values of respective phases of 4th, 5th, 6th and 7th driving signals DS4, DS5, DS6 and DS7 becomes zero to drive plurality of lamps 244*a*, 244*b*, 244*a*, 244*b*, 248*a*, 248*b*, 250*a* and 250*b*.

On the other hand, lamps 244*a*, 244*b*, 244*a*, 244*b* 248*a*, 248*b*, 250*a* and 250*b* may be, as shown in FIG. 25, formed by combining adjacent two lamps as pairs, and directly connecting the second electrodes of two lamps in a single pair on the electrical basis.

In FIG. 25, a 12th inverter INV12 is formed by transformers (not shown) numbering the same as the number of plurality of lamps 244*a*, 244*b*, 244*a*, 244*b*, 248*a*, 248*b*, 250*a* and 250*b* and a stabilizing circuit (not shown). The output terminals at the low voltage level of the secondary sides of the plurality of transformers constituting 12th inverter INV12 are directly connected to the stabilizing circuit to supply the feedback current for stabilizing the current of plurality of lamps 244*a*, 244*b*, 244*a*, 244*b*, 248*a*, 248*b*, 250*a* and 250*b* to the stabilizing circuit.

At this time, the driving signals respectively supplied to the first electrodes of plurality of lamps 244*a*, 244*b*, 244*a*, 244*b*, 248*a*, 248*b*, 250*a* and 250*b* are identical to those shown in FIG. 17. That is, the driving signals are supplied from the plurality of transformers of 12th inverter INV12 to be fed to each of the lamp pairs, e.g., lamps 244*a*& 244*b*, lamps 244*b* & 244*a*, lamps 244*a*& 244*b*, lamps 244*b*& 248*a*, lamps 248*a*& 250*a* and lamps 250*a* & 250*b*, which are directly connected among plurality of lamps 244*a*, 244*b*, 244*a*, 244*b* 248*a*, 248*b*, 250*a* and 250*b* to have the phase difference of 180° from each other.

According to the backlight assembly and LCD device having the same as described above, the lamps employed to the backlight assembly for supplying the light are driven by the AC signals from the inverter module consisting of the transformers, controllers and stabilizing circuit.

At this time, the numbers of the lamps and the transformers in the inverter module are the same or two transformers may be used. If the numbers of the lamps and the transformers number the same, the first electrodes of the lamps are respectively connected to the output terminals at the high voltage level of the secondary sides of the corresponding transformers among the plurality of transformers within the inverter module, and the second electrodes of the lamps are directly connected to the other on the electrical basis. In addition, when two transformers are employed, the plurality of lamps are serially connected to allow the first electrodes of the most preceding lamp and finally succeeding lamp to be connected to the output terminals at the high voltage level of the secondary sides of two transformers.

Furthermore, the output terminals at the low voltage level of the secondary sides of the plurality of transformers are directly connected to the stabilizing circuit within the inverter module to supply the feedback current for stabilizing the current of the lamps to the stabilizing circuit. Also, when the plurality of lamps are serially connected, the AC signals supplied from the inverter module to the lamps are provided to have the phase difference of 180° in the lamps adjacent to each other. Unlike this, if the first electrodes of the plurality of lamps are respectively supplied with the driving signals from the corresponding transformers while the second electrodes are directly connected to each other, respective first electrodes of the plurality of lamps are supplied with the driving signals to have the phase difference of one period of the AC signals in the sine waveform, i.e., the value obtained by dividing 360° by the number of lamps.

As a result, respective second electrodes of the lamps are not required to extend to the stabilizing circuit of the inverter module for supplying the feedback current to the stabilizing circuit regardless of the number of lamps, thereby employing no RTNs.

Therefore, the wiring structure of the electrode lines of the lamps employed into the backlight assembly is simplified to reduce not only the size of the backlight assembly but also the manufacturing cost of the backlight assembly and LCD device.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A backlight assembly, comprising:

a light source having a plurality of lamps;

a light controlling device that enhances a luminance of light supplied from the light source, wherein each of the plurality of lamps have two electrodes, and the two electrodes include a first electrode directly connected to an electrode of at least one adjacent lamp and a second electrode for receiving driving signals; and a plurality of transformers, wherein each of the plurality of transformers having a secondary side including a high voltage level terminal and a low voltage level terminal, wherein the low voltage terminal of the secondary side of the plurality of transformers is connected to a stabilizing circuit and each of the high voltage level terminal of the secondary side of the plurality of transformers is connected to the second electrodes of each of the plurality of lamps.

2. The backlight assembly of claim 1, wherein the driving signals comprise a first driving signal and a second driving signal having different phases from each other.

3. The backlight assembly of claim 2, wherein the first driving signal and the second driving signal have a phase difference of 180° from each other.

4. The backlight assembly of claim 3, wherein the light source comprises at least a first lamp and a second lamp connected in series to each other, wherein the second electrode of the first lamp receives the first driving signal and the second electrode of the second lamp receives the second driving signal.

5. The backlight assembly of claim 2, further comprising:

a driver for converting an external power source of a DC component into an AC component, wherein the driver generates the first driving signal and the second driving signals having the different phase from each other.

6. The backlight assembly of claim 5, wherein the driver comprises a first transformer and a second transformer for generating the first driving signal and the second driving signals, respectively.

7. The backlight assembly of claim 6, wherein the driver includes the stabilizing circuit for stabilizing current for the plurality of lamps.

8. The backlight assembly of claim 7, wherein a feedback current for stabilizing the current of the plurality of lamps is supplied to the stabilizing circuit from the low voltage level terminal of the secondary side of the plurality of transformers.

9. The backlight assembly of claim 1, wherein the number of driving signals equals the number of the plurality of lamps.

10. The backlight assembly of claim 9, wherein the number of driving signals are at least equal to N, where N is a constant no less than 2, and the driving signals have different phases from each other.

11. The backlight assembly of claim 10, wherein the N driving signals have a phase difference from each other equal to a value obtained by dividing 360° by the number of the plurality of lamps.

12. The backlight assembly of claim 11, wherein a sum of the phases of the N driving signals is zero.

13. The backlight assembly of claim 10, further comprising:

a driver for converting a DC power source component into an AC component, wherein the driver generates the N driving signals.

14. The backlight assembly of claim 13, wherein the driver includes a plurality of transformers equal in number to the plurality of lamps.

15. The backlight assembly of claim 13, wherein the stabilizing circuit is for stabilizing the current for the plurality of lamps.

16. The backlight assembly of claim 15, wherein a feedback current for stabilizing the current of the plurality of lamps is supplied to the stabilizing circuit from the low voltage level terminal of the secondary side of each of the plurality of transformers.

17. A liquid crystal display device, comprising:

a backlight assembly having a light source with a plurality of lamps, and a light controlling device for enhancing luminance of light supplied from the light source; and a display unit arranged near an upper plane of the light controlling device, the display unit for receiving the light from the light source through the light controlling device and displaying an image, wherein each of the plurality of lamps have two electrodes, and the two electrodes include a first electrode directly connected to an electrode of at least one adjacent lamp and selectively have a second electrode that receives driving signals, wherein the display unit includes a plurality of transformers, wherein each of the plurality of transformers having a secondary side including a high voltage level terminal and a low voltage level terminal, wherein the low voltage terminal of the secondary side of the plurality of transformers is connected to a stabilizing circuit and each of the high voltage level terminal of the secondary side of the plurality of transformers is connected to the second electrodes of each of the plurality of lamps.

18. The liquid crystal display device of claim 17, wherein the light source is arranged to contact both ends of the light controlling device, and the light controlling device includes an edge-type light guide plate that has substantially the same thickness at both ends near the light source.

19. The liquid crystal display device of claim 17, wherein the light source is arranged in contact with one end of the light controlling device.

20. The liquid crystal display device of claim 19, wherein the light controlling device includes a wedge-type light guide plate that becomes thinner as advancing from a first end near the light source to a second end opposite to the first end.

21. The liquid crystal display device of claim 17, wherein the light source is arranged on a lower portion of the light controlling device.

22. The liquid crystal display device of claim 21, wherein the light controlling device includes a plurality of optical sheets for making the luminance of light supplied from the light source to the display unit substantially consistent.

23. The liquid crystal display device of claim 17, wherein the driving signals include a first driving signal and a second driving signal having a different phase from each other.

24. The liquid crystal display device of claim 20, wherein the first driving signal and the second driving signals have a phase difference of 180° from each other.

25. The liquid crystal display device of claim 24, wherein the light source includes at least two lamps connected in series to each other, wherein electrodes of a most preceding lamp and a finally succeeding lamp receives the first driving signal and the second driving signal, respectively.

26. The liquid crystal display device of claim 23, further comprising a driver for converting an external DC power source component into an AC component, wherein the driver generates the first driving signal and the second driving signals having different phases from each other.

27. The liquid crystal display device of claim 26, wherein the driver comprises at least two transformers for generating the first driving signal and the second driving signals, respectively.

28. The liquid crystal display device of claim 27, wherein a feedback current for stabilizing the current for the plurality of lamps is supplied to the stabilizing circuit from the low voltage level terminal of the secondary sides of the respective transformers.

29. The liquid crystal display device of claim 17, wherein the driving signals are equal in number to the number of the plurality of lamps.

30. The liquid crystal display device of claim 29, wherein the driving signals comprise at least N, where N is a constant no less than 2, driving signals having different phases, respectively.

31. The liquid crystal display device of claim 30, wherein the N driving signals have a phase difference from each other equal to a value obtained by dividing 360° by the number of the plurality of lamps.

32. The liquid crystal display device of claim 31, wherein a sum of respective phases of the N driving signals is equal to zero.

33. The liquid crystal display device of claim 30, further comprising:

a driver for converting an external DC power source component into an AC component, wherein the driver generates the N driving signals having different phases from one another, respectively.

34. The liquid crystal display device of claim 33, wherein the driver comprises the plurality of transformers equal to the number of plurality lamps in the light source.

35. The liquid crystal display device of claim 33, wherein the stabilizing circuit substantially stabilizes the current for the plurality of lamps.

36. The liquid crystal display device of claim 35, wherein a feedback current for stabilizing the current for the plurality of lamps is supplied to the stabilizing circuit from the low voltage level terminal of the secondary sides of each of the plurality of transformers.

* * * * *

UNITED STATES PATENT AND TRADEMARK OFFICE

CERTIFICATE OF CORRECTION

PATENT NO. : 6,661,181 B2
DATED : December 9, 2003
INVENTOR(S) : Chung-Hyuk Shin It is certified that error appears in the above-identified patent and that said Letters Patent is hereby corrected as shown below:

Column 22,
Line 14, change “claim 20” to -- claim 23 --.
Lines 15, 26 and 29, change “signals” to -- signal --.
Line 34, change “sides” to -- side --.

Signed and Sealed this

Ninth Day of March, 2004

JON W. DUDAS
*Acting Director of the United States Patent and Trademark Office*